US008950962B2

(12) United States Patent
Bouix et al.

(10) Patent No.: US 8,950,962 B2
(45) **Date of Patent: *Feb. 10, 2015**

(54) HEATING APPLICATOR SYSTEM FOR PRODUCTS THAT MAY BE DEGRADED BY HEAT

(75) Inventors: Herve F. Bouix, New York, NY (US); Francis Corbellini, Thiais (FR); Christophe Jacob, Saint Denis le Thiboult (FR)

(73) Assignee: ELC Management, LLC, New York, NY (US)

( * ) Notice: Subject to any disclaimer, the term of this patent is extended or adjusted under 35 U.S.C. 154(b) by 431 days.

This patent is subject to a terminal disclaimer.

(21) Appl. No.: 13/330,765

(22) Filed: Dec. 20, 2011

(65) Prior Publication Data

US 2012/0325235 A1 Dec. 27, 2012

Related U.S. Application Data

(63) Continuation-in-part of application No. 12/980,526, filed on Dec. 29, 2010, now Pat. No. 8,585,307.

(51) Int. Cl.

| | |
|---|---|
| ***A46B 11/08*** | (2006.01) |
| ***A45D 40/26*** | (2006.01) |
| ***A46B 7/04*** | (2006.01) |
| ***A46B 11/00*** | (2006.01) |
| ***A46B 15/00*** | (2006.01) |

(52) U.S. Cl.

CPC ..... *A45D 40/265* (2013.01); *A45D 2200/155* (2013.01); *A45D 2200/157* (2013.01); *A46B 7/04* (2013.01); *A46B 11/0003* (2013.01); *A46B 15/003* (2013.01); *A46B 2200/1053* (2013.01)

USPC ..... 401/1; 401/126

(58) Field of Classification Search

USPC ..... 401/1, 126; 132/218

See application file for complete search history.

(56) References Cited

U.S. PATENT DOCUMENTS

| | | | |
|---|---|---|---|
| 2,488,591 | A | 11/1949 | Fevas |
| 3,518,410 | A | 6/1970 | Dillarstone |

(Continued)

FOREIGN PATENT DOCUMENTS

| | | |
|---|---|---|
| DE | 19839940 | 3/2000 |
| EP | 1563760 | 8/2005 |

(Continued)

OTHER PUBLICATIONS

Mince, Thermofoil Heaters (on-Line), 2005 (Retrieved on Mar. 22, 2006). Retrieved from the Internet: URL: http://www.minco.com/products/heaters.aspx.

(Continued)

*Primary Examiner* — Kevin P Shaver
*Assistant Examiner* — Jennifer C Chiang
(74) *Attorney, Agent, or Firm* — Peter Giancana

(57) ABSTRACT

A system for sampling a heated product comprising a disposable first subassembly having an applicator head, and a physically separate reusable second subassembly having an electric heating circuit. Prior to use, the two subassemblies are able to form a rigid connection. As a result of forming this connection, the applicator head is transferred to the second subassembly such that a portion of the electric heating circuit is inserted into an interior space of the applicator head. In this configuration, the second subassembly is used to apply heated product.

26 Claims, 18 Drawing Sheets

(56) References Cited

U.S. PATENT DOCUMENTS

| | | | | |
|---|---|---|---|---|
| 4,067,480 | A | 1/1978 | Gasser | |
| 4,274,588 | A | 6/1981 | Schwob | |
| 4,291,685 | A | 9/1981 | Taelman | |
| 4,329,567 | A | 5/1982 | Kunz et al. | |
| 4,465,073 | A | 8/1984 | Schwob | |
| 4,538,630 | A | 9/1985 | Henderson | |
| 4,733,784 | A | 3/1988 | Bennett | |
| 4,889,440 | A | 12/1989 | Shano | |
| 5,096,319 | A | 3/1992 | Gueret | |
| 5,395,175 | A | 3/1995 | Bontoux et al. | |
| 5,513,771 | A | 5/1996 | Cote | |
| 5,556,468 | A | 9/1996 | Legrain et al. | |
| 5,620,270 | A * | 4/1997 | Gueret | 401/126 |
| 5,775,344 | A | 7/1998 | Clay | |
| 5,851,079 | A | 12/1998 | Horstman et al. | |
| 5,853,010 | A | 12/1998 | Suh | |
| 5,911,226 | A | 6/1999 | Vecchiola et al. | |
| 6,009,884 | A | 1/2000 | Suh | |
| 6,454,127 | B1 | 9/2002 | Suomela et al. | |
| 6,508,603 | B1 | 1/2003 | Vasas | |
| 6,911,010 | B2 | 6/2005 | Dirks et al. | |
| 7,083,347 | B2 | 8/2006 | Marcotte et al. | |
| 7,086,861 | B2 | 8/2006 | Pitz et al. | |
| 7,090,420 | B2 | 8/2006 | DeLaPoterie et al. | |
| 7,108,438 | B2 | 9/2006 | Fontaine | |
| 7,227,108 | B2 | 6/2007 | Clothier et al. | |
| 7,322,366 | B2 | 1/2008 | Cho | |
| 7,448,814 | B2 | 11/2008 | Bouix et al. | |
| 7,465,114 | B2 | 12/2008 | Kress et al. | |
| 7,669,605 | B2 | 3/2010 | Cho | |
| 7,753,609 | B2 * | 7/2010 | Bouix et al. | 401/129 |
| 7,909,044 | B2 | 3/2011 | Tranchant et al. | |
| 7,980,776 | B2 * | 7/2011 | Cho | 401/1 |
| 8,262,302 | B1 * | 9/2012 | Bouix et al. | 401/1 |
| 8,585,307 | B2 * | 11/2013 | Bouix et al. | 401/129 |
| 2004/0096258 | A1 | 5/2004 | Kim | |
| 2004/0247367 | A1 | 12/2004 | Fontaine | |
| 2005/0013838 | A1 | 1/2005 | De La Poterie | |
| 2005/0031656 | A1 | 2/2005 | Pays et al. | |
| 2005/0244209 | A1 | 11/2005 | Gueret | |
| 2005/0258172 | A1 | 11/2005 | Gueret | |
| 2006/0032512 | A1 | 2/2006 | Kress et al. | |
| 2006/0246118 | A1 | 11/2006 | Gueret | |
| 2006/0251686 | A1 | 11/2006 | Gueret | |
| 2007/0206986 | A1 | 9/2007 | Gueret | |
| 2007/0273331 | A1 | 11/2007 | Cross et al. | |
| 2007/0286665 | A1 | 12/2007 | Bouix et al. | |
| 2007/0286666 | A1 | 12/2007 | Bouix et al. | |
| 2008/0216857 | A1 | 9/2008 | Tranchant et al. | |
| 2008/0236608 | A1 | 10/2008 | Tranchant et al. | |
| 2008/0273911 | A1 | 11/2008 | Gueret | |
| 2009/0020133 | A1 | 1/2009 | Gueret | |
| 2010/0024836 | A1 | 2/2010 | Degennes | |
| 2010/0054841 | A1 | 3/2010 | Cho | |
| 2010/0086507 | A1 | 4/2010 | Gueret | |
| 2011/0076085 | A1 | 3/2011 | Jollet et al. | |

FOREIGN PATENT DOCUMENTS

| | | |
|---|---|---|
| FR | 2891394 | 3/2007 |
| GB | 2174896 | 11/1986 |
| JP | S59-101911 | 7/1984 |
| JP | S63-147116 | 9/1988 |
| JP | 07-120425 | 5/1995 |
| JP | 2000-514607 | 10/2000 |
| JP | 2001-522219 | 11/2001 |
| JP | 2002-308355 | 10/2002 |
| JP | 2004-079811 | 3/2004 |
| JP | 2006-093468 | 4/2006 |
| JP | 2009-502110 | 1/2009 |
| JP | 2009539494 | 11/2009 |
| WO | WO97/10649 | 3/1997 |
| WO | WO99/23746 | 5/1999 |
| WO | WO2007/011370 | 1/2007 |
| WO | WO 2007/114551 | 10/2007 |

OTHER PUBLICATIONS

International Search Report mailed Mar. 3, 2008, of PCT/US07/69759.

Written Opinion of the ISA dated Mar. 3, 2008, of PCT/US07/69759.

Related Application: Bouix and Jacob, "Heated Masacara Applicator and Suitable Compositions," U.S. Appl. No. 12/732,835, filed Mar. 26, 2010.

Related Application: Bouix and Jacob, "Heated Masacara Applicator and Suitable Compositions," U.S. Appl. No. 11/422,729, filed Jun. 7, 2006.

Related Application: Bouix and Jacob, "Cosmetic Applicators Containing Heating Elements," U.S. Appl. No. 12/730,789, filed Mar. 24, 2010.

Related Application: Bouix, et al., "Reuseable Pump Dispenser for Heated Personal Care Compositions," U.S. Appl. No. 12/948,840, filed Nov. 18, 2010.

Related Application: Bouix, et al., "A System for Sampling a Heated Product." U.S. Appl. No. 12/980,526, filed Dec. 29, 2010.

Related Application: Bouix, et al., Bouix, et al., "Capacitor Powered Personal Care Devices," U.S. Appl. No. 13/100,806, filed May 4, 2011.

Related Application: Bouix, et al.; "A Kit for a Heating Applicator and Product;" U.S. Appl. No. 13/330,832, filed Dec. 20, 2011.

PCT International Search Report; International Application No. PCT/US2011/066229; Completion Date: Aug. 28, 2012; Date of Mailing: Aug. 29, 2012.

PCT Written Opinion of the International Searching Authority; International Application No. PCT/US2011/066229; Completion Date: Aug. 28, 2012; Mailing Date: Aug. 29, 2012.

* cited by examiner

HEATING APPLICATOR SYSTEM FOR PRODUCTS THAT MAY BE DEGRADED BY HEAT

This application is a continuation in part of U.S. application Ser. No. 12/980,526, filed Dec. 29, 2010 now U.S. Pat. No. 8,585,307.

FIELD OF THE INVENTION

The present invention is in the field of cosmetic and personal care products. In particular, the present invention concerns a heating applicator system for mascara or other products that tend to dry out or be adversely affected when heated.

BACKGROUND

Heating mascara applicators have only recently begun to appear on the market, and their presence in the marketplace may grow significantly in years to come. In co-pending application U.S. Ser. No. 12/980,526, we explained that one impediment to market acceptance is lack of familiarity with heated mascara application, and we described a system for sampling a heated product at a store counter. In the present application we tackle another impediment to market acceptance; the problem of product dry-out as a result of repeated exposure to heat. Full size, salable mascara products may typically supply about 4 g to about 10 g of mascara. If a single use includes making up two eyes, then many full size saleable mascara products are used 100 times or more, before being discarded. However, it has been observed that after tens of uses, a heated applicator can cause the formula in the reservoir to dry out, rendering the mascara unusable. Furthermore, residual product that remains on the applicator head also dries out, and builds up on the working surface of the applicator. After just tens of uses of the applicator, this build up of dried out material interferes with the performance of the applicator. Thus, the customer is frustrated, and the benefits of a heated mascara have not been realized.

The problems just described are not limited to mascara. Any product that utilizes a heated applicator to deliver the formula may be degraded by too much exposure to heat. What is still needed then, is a way to provide a consumer with a saleable amount of cosmetic or personal care product for use with a heated applicator, while avoiding the problems associated with heat exposure in the reservoir and on the applicator head. The present invention overcomes these problems of heat exposure by incorporating certain improvements into the sampling technology previously described in co-pending application U.S. Ser. No. 12/980,526.

OBJECT OF THE INVENTION

A main object of the present invention is to provide a heating applicator system and a saleable amount of cosmetic or personal care product, that alleviates the problems associated with heat exposure in the reservoir and on the applicator head.

SUMMARY

This summary is provided merely as an introduction and does not, by itself, limit the appended claims. According to one aspect, the present invention comprises a set of disposable first subassemblies (designated FS) and at least on reusable second subassembly (designated SS). Each first subassembly comprises a reservoir of product and an applicator head that is initially mounted in the reservoir. The mounting of the applicator head seals the reservoir and protects the product in the reservoir prior to use. The reusable second subassembly comprises a handle, a heat generating portion, and a power source. The second subassembly is able to be attached to and detached from the first subassembly. When the second subassembly is attached to one of the first subassemblies, then the heat generating portion is disposed inside the applicator head for heating product in the reservoir and/or on the applicator head. Also, when the second subassembly is attached to the first subassembly, then the applicator head can be removed from its mounting in the reservoir so that the applicator head becomes associated with the second subassembly. When the product in the reservoir is used up, then the reusable second subassembly can be detached from the applicator head. The applicator head and exhausted reservoir are disposed, while the second subassembly is reused with another first subassembly. The following description should not be construed as limiting the scope of this invention, except as set forth in the claims.

DEFINITIONS

Figure 1:
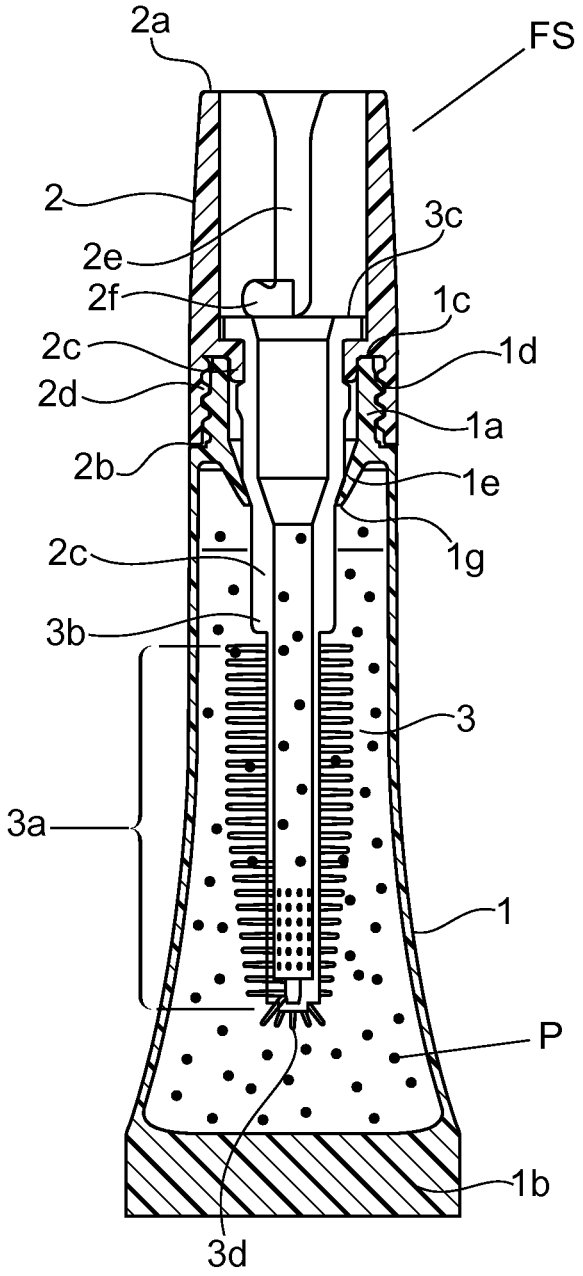
FIG. 1 is a cross sectional view of one embodiment of a disposable first subassembly of the present invention.

"Product application temperature" means a temperature of the product that is greater than ambient temperature, at which some characteristic of the product is enhanced or improved. For example, ambient temperature may be taken to be 20° C. to 25° C., while product application temperature may be 30° C. or greater, or 40° C. or greater, or 50° C. or greater, or 60° C. or greater, and so on, as the situation dictates. The improved characteristic may relate to application of the product to the skin or hair, or it may relate to the performance or shelf life of the product. Furthermore, the improved characteristic may relate to a consumer's experience or expectation of the product. For example, the characteristic improvement may be a pre-defined reduction in viscosity. Or, for example, it may be activation of an active ingredient above a threshold temperature. Or, for example, the improved characteristic may be longer shelf life due to a reduction in harmful microbes in the product. Or the improved characteristic may be a feeling of warmth, experienced by the consumer.

"Handheld applicator" means an applicator that is intended to be held in one hand, or at most two hands, and raised in the air as the applicator is performing one or more main activities. Main activities include using the applicator to transfer product from the reservoir to an application surface. Thus, "handheld" means more than just being able to grasp an object. For example, a "space heater" does not meet this definition of handheld.

Throughout the specification "comprise" means that an element or group of elements is not automatically limited to those elements specifically recited, and may or may not include additional elements.

Throughout the specification, "electrical contact" means that, if a potential difference is provided between electronic elements, then an electric current is able to flow between those elements, whether there is direct physical contact between the elements or whether one or more other conductive elements intervene.

By "fluid tight", we mean a seal that is sufficiently tight to prevent product from leaking out of the reservoir, and sufficiently tight to slow down the degradation of product in the reservoir. Preferably, the fluid tight seal also means that the seal is able to prevent oxidation of a product in the reservoir. By "prevent oxidation, we mean that the product remains in a saleable condition (as a person of ordinary skill in the art would understand "saleable condition") for a period of at least six months, preferably for a period of at least one year, at standard temperature and pressure.

DETAILED DESCRIPTION

A number of embodiments of the present invention are described below. Certain features are essential to all embodiments of the invention. Certain other features are optional and/or preferred, but not essential. The non essential features are not limited to being used in the embodiment in which they are shown herein, but may find use in any of the embodiments shown herein, or in any other embodiments that adhere to the principles of the present invention.

Overview of a Heating Applicator System

One aspect of the invention that is common to several embodiments is a disposable first subassembly (FS) that comprises a reservoir that is capable of holding a product, a neck extension that is connected to the reservoir in a detachable/reattachable manner, and an applicator head that depends from the neck extension into the reservoir. A portion of the neck extension seals off the product in the reservoir from the ambient atmosphere outside of the first subassembly. From outside the first subassembly, a conduit exists through the neck extension and into an interior space of the applicator head.

Another aspect of the present invention that is common to several embodiments is a reusable second subassembly (SS) that is separable from the first subassembly, but which must be attached to the first subassembly at the time of use. The second subassembly comprises a handle, an electric circuit housing, an electric heating circuit, an on-off mechanism, and a power source. Taken together, a first and second subassembly make up a heating applicator system according to the present invention.

Prior to use, the electric circuit housing of the second subassembly (SS) and the neck extension of the first subassembly (FS) are able to form a sufficiently rigid connection. As a result of forming this connection, a portion of the electric heating circuit is inserted through the neck extension and into the interior space of the applicator head. In this configuration, the neck extension and applicator head can be separated from the reservoir for use in applying the product. After each use, the neck extension with applicator head may be reattached to the reservoir to seal it off. When the product in the reservoir is used up, then the electric circuit housing and neck extension can be separated, so that the second subassembly can be reused, while the components of the first subassembly are discarded. Unlike the single-use reservoir of co-pending application U.S. Ser. No. 12/980,526, the multiple-use reservoir of the present invention is able to be resealed to protect the product remaining in the reservoir. However, in preferred embodiments of the present invention, the first subassembly is still considered to be "disposable", because after the contents of the reservoir are exhausted, it cannot be reused.

The Disposable First Subassembly (FS)

The disposable first subassembly (FS) comprises a reservoir (1), a neck extension (2) that is connected to the reservoir in a detachable/reattachable manner, and an applicator head (3) that depends from the neck extension into the reservoir. The first subassembly is considered as "disposable" because after a user has exhausted the contents of the reservoir, the reservoir, neck extension and applicator head are disposed.

The Reservoir: Referring to FIG. 1, the reservoir (1) holds or is able to hold a product (P). The reservoir may typically be cylindrical or have a cylindrical portion, and be fully or partly made of plastic, but this is not required. In the figures, the reservoir is depicted as a plastic tube. The reservoir has a top end that may preferably be in the form of a hollow neck (1*a*), and a bottom end (1*b*). An upper orifice (1*c*) located in the top end of the reservoir offers access to the interior of the neck and reservoir. At its top end, the neck of the reservoir is connected to a neck extension.

In various embodiments, the bottom end (1*b*) of the reservoir (1) may be closed before or after filling the reservoir with product, depending on the type of reservoir. For example, if the reservoir is a rigid bottle for holding mascara, then the bottom of the reservoir will be closed when the bottle is molded. In this case, the reservoir is filled through the upper orifice (1*c*) located in the neck (1*a*) of the reservoir. Alternatively, in some embodiments of the present invention, the bottom end of the reservoir is initially opened for filling product into the reservoir, and subsequently closed. For example, if the reservoir is a flexible tube, it is possible to assemble the first subassembly, and then fill the reservoir through the bottom end of the tube. Thereafter, the bottom end of the tube can be sealed according to known methods, such as heat welding or sonic welding.

Preferably, a down-turned portion (1*e*) is integrally molded with and depends from the perimeter of the lower end of the neck (1*a*) into the reservoir. This down-turned portion defines a lower orifice (1*g*) of the neck. The lower orifice is sufficiently large to allow an applicator head to pass there-through, but sufficiently small so that the down-turned portion acts as a wiper element for the applicator head. For achieving a wiping effect, the down-turned portion may be conical, as shown. The height of the conical down-turned portion may be varied as needed to effectively clean the applicator head. However, in practice this wiper element may be significantly shorter than conventional wiper elements because the system of the present invention is intended to be used for relatively fewer applications. Thus, the issues of messy product build up and dry-out are not relevant, or not as relevant, as with full size saleable mascara packages.

The Neck Extension: Referring again to FIG. 1, the neck (1*a*) of the reservoir (1) is connected to a hollow neck extension (2), such that the orifice (1*c*) of the reservoir is surrounded by the neck extension. The neck extension has a top end (2*a*) and a bottom end (2*b*), and a passageway exists through the neck extension between the top and bottom ends. Nearer the bottom end, an interior surface of the neck extension has a means of connecting to the neck (1*a*) of the reservoir. The connection between the reservoir neck and the neck extension is preferably detachable and reattachable, as this is how the product in the reservoir is accessed. Preferably, when the two components are attached, they maintain a fluid tight connection to prevent dry-out of the product in the reservoir. Thus, in preferred embodiments, the neck extension has threads (2*d*) formed on its interior surface, which cooperate with threads (1*d*) located on an exterior surface of the reservoir neck (1*a*). By means of screwing and unscrewing, the reservoir and neck extension may be repeatedly attached and detached. When the neck extension is screwed down onto the neck, an L-shaped portion (2*c*) of the neck extension comes to bear down on the top of the neck, forming a seal between those parts.

In other embodiments, the reservoir and neck extension may be connected by an interference engagement (i.e. friction fitting, snap fitment, lug fitment) that can be overcome and reengaged by manual pressure. In this case, the neck extension may be sized fit inside the reservoir or vice versa.

Nearer its top end (2*a*), the neck extension (2) further comprises a means for connecting the first and second subassemblies. The connection between subassemblies is detachable so that the second subassembly can be reused with a different first subassembly. Various connection means can be used. For example, the connection means may be a second set of threads formed on an interior surface of the neck extension, which cooperate with threads located on an exterior surface of the second subassembly. By means of screwing and unscrewing, the first and second subassemblies could be attached and detached. In FIG. 1, however, the connection between the first and second subassemblies is implemented as at least one bayonet style or lug style locking mechanism. For example, the neck extension (2) may be provided with a transit groove (2*e*) on its interior surface that extends downward from the top end (2*a*) of the neck extension, and terminates in a locking groove (2*f*), which may extend at an approximately right angle to the transit groove. More than one set of transit and locking grooves may be provided. For each set of grooves, a cooperating lug (5*d*) located on an exterior surface of the second subassembly is able to travel down the transit groove, and enter into the locking groove, from which it cannot back out without some manual effort. The limited amount of rotation (i.e. quarter turn or less) required to secure this type of connection, compared to a threaded engagement, may be preferable to prevent damage to a heat generating portion or to the lower portion of a printed circuit board, as we will see. Alternatively, the first and second subassemblies may be connected by some other interference engagement (i.e. friction fitting, snap fitment, cam-and-groove coupling, lug-style coupling, etc.) that can be disengaged and reengaged by manual effort.

The Applicator Head: An applicator head (3) comprises a hollow stem (3*b*), that has an opened proximal portion (3*c*) and a closed distal portion (3*d*). The closed distal portion supports a working surface (3*a*). A typical form of the working surface may be a bristle brush, such as those used for eyelash makeup and grooming, but the invention is not so limited. The hollow stem (3*b*) articulates with the neck extension (2), preferably forming a fluid tight seal. For example, the opened proximal portion (3*c*) of the hollow stem may be shaped complementarily to the L-shaped portion (2*c*) of the neck extension, and sized to fit snugly into the L-shaped portion. Alternatively, the neck extension and applicator head could be integrally molded.

In general, the opened proximal portion (3*c*) of the applicator head (3) and the L-shaped portion (2*c*) of the neck extension (2) do not separate during normal consumer use. Once assembled, the neck extension and applicator head act as one unit. For example, the opened proximal portion could be bonded to the interior of the L-shaped portion with adhesive. Alternatively, the neck extension and applicator head could be integrally molded.

When the reservoir (1), neck extension (2) and applicator head (3) are assembled as described herein, the product (P) in the reservoir is sealed off from the ambient environment, and the working surface (3*a*) of the applicator head is immersed in the product. Furthermore, when the reservoir, neck extension, and applicator head are assembled, a passage exists through the top end (2*a*) of the neck extension, through the interior of the neck extension, through the opened proximal portion (3*c*) of the applicator head, and into the closed distal portion (3*d*) of the applicator head. Thus the interior of the applicator head is accessible from outside of the first subassembly. For example, when the first subassembly is assembled, the applicator head is still able to receive into itself a heat generating portion.

Regarding the first subassembly, what is essential is that the neck extension (2) and the applicator head (3) can be repeatedly connected to, and disconnected from the reservoir (1), such that when connected, the applicator head is disposed in the reservoir, and the connection is fluid tight, as defined above. Furthermore, what is essential is that the neck extension is able to temporarily connect to a second subassembly such that, when connected, a heat generating portion is disposed inside the applicator head.

The Reusable Second Subassembly (SS)

Various embodiments of the second subassembly (SS) comprise a handle, a heating circuit housing, a switchable electric heating circuit, and one or more means of engaging the electric heating circuit. The second subassembly is considered as "reusable" because even after a user has disposed of the first subassembly, the second subassembly can be reused with a new first subassembly.

The Reusable Second Subassembly—A First Set of Embodiments (SS1)

The Handle: In various embodiments, the handle (4) is shown as a hollow cylindrical structure, but the shape may vary. In general, the handle is large enough to be grasped by a user of personal care products, as is typically done in the field. For example, the handle may be part of a mascara applicator that is from 15 mm to 150 mm in length, and from 10 mm to 50 mm in diameter.

Figure 2A:
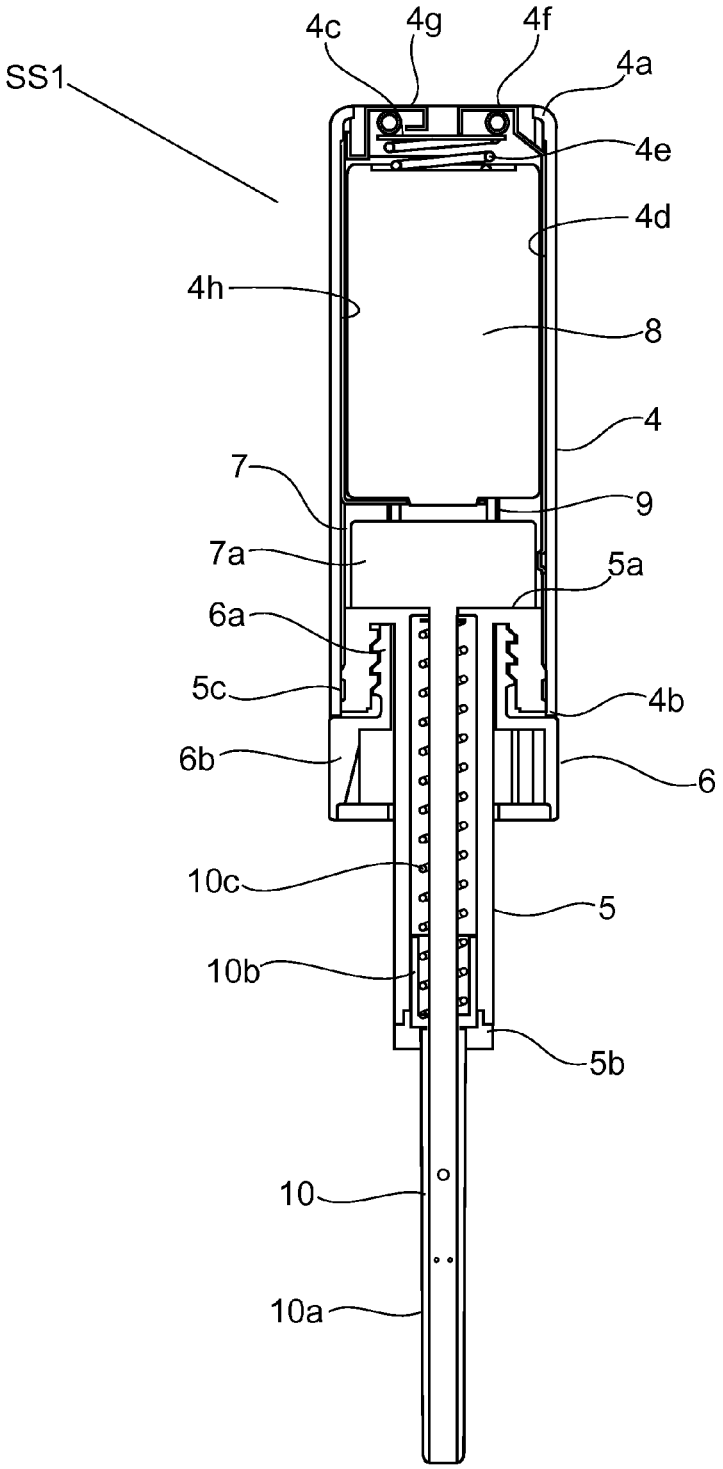
FIG. 2A is a cross sectional view of a first embodiment of a reusable second subassembly of the present invention.
Figure 2B:
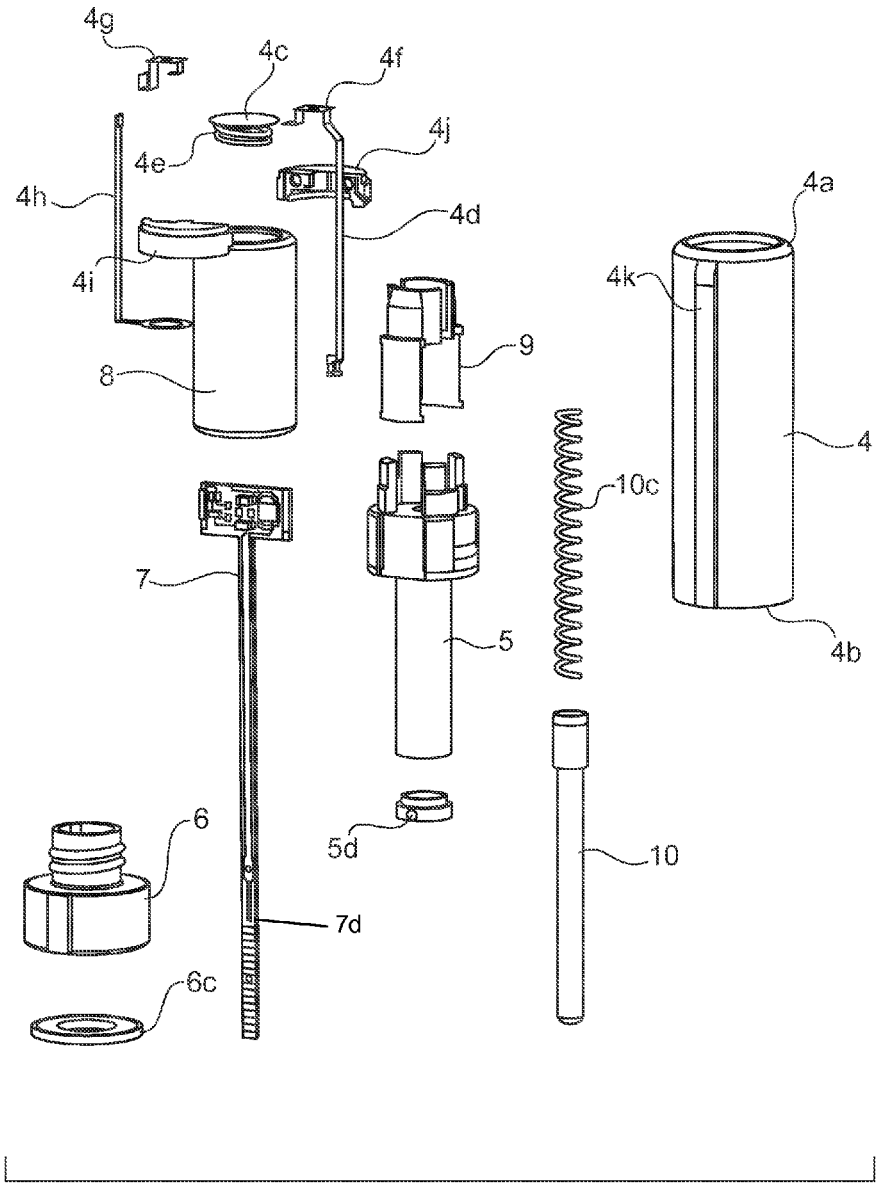
FIG. 2B is an exploded view of the second subassembly of FIG. 2A

Referring to FIGS. 2A and 2B, a proximal end (4*a*) of the handle (4) defines the proximal end of the second subassembly. The proximal end is closed, but may have a removable cap (not shown) at its proximal end. The removable cap would offer access to the interior of the handle, and/or access to a power source/current source (8) for changing the power source/current source, for example. Opposite the proximal end of the handle, is a distal, opened end (4*b*). In this and other embodiments, the handle does not generally act as a closure for the container, as is commonly done in the art. The interior of the handle is sufficiently large to accommodate a power source (8), and a portion of the switchable electric heating circuit. For example, a first and second metallic leads (4*d*, 4*e*) may be attached to an inner surface of the handle, such that the leads are able conduct electricity from a heat generating portion toward the negative terminal of the current source. In some embodiments, the second metallic lead is formed as a spring, which, in a compressed state, urges the current source toward the opened end (4*b*) of the handle. Optionally, the upper end of the spring (4*e*) is attached to a conductive plate (4*c*) which provides a flat surface for making sure electrical contact with the spring.

Optionally, the power source may be rechargeable. To that end, the handle (4) may be provided with a removable cap(not shown), which would allow the power source (i.e. a battery) to be removed from the handle for recharging. More preferably, the exterior of the handle is provided with recharging leads that allow a battery to be connected to an external power reservoir. The recharging leads must be such that when the external power reservoir is connected, a recharging circuit is completed that is effective to transmit power from the external power reservoir to a battery for storage. For example, in the embodiment of FIG. 2A, recharging leads (4*f* and 4*g*) are accessible from outside of the handle (4). Recharging lead (4*f*) connects to the negative terminal of a battery through conductive plate (4*c*) and spring (4*e*), while recharging lead (4*g*) is sometimes connected to the positive terminal of the battery through recharging lead (4*h*). Recharging lead (4*h*) is welded to the positive terminal of the battery so that the lead moves with up and down with the battery. As it moves up, recharging lead (4*h*) makes contact with recharging lead (4*g*), making it possible to recharge the battery if the device is disposed into a recharging base. As it moves down, recharging lead (4*h*) breaks contact with recharging lead (4*g*), in which condition it is impossible to recharge the battery. Referring to FIG. 2B, semi-circular forms (4*i*, 4*j*) may be provided to secure recharging leads (4*f*, 4*g*) in a fixed configuration. The semi-circular forms are mated to the interior shape of the handle (4) such that, once assembled, the forms do not move. The recharging leads are sandwiched between the semicircular forms which are molded to receive the shape of the recharging leads. Optionally, the exterior of the handle may be provided with a mean of registering each recharging lead (4*f*, 4*g*) with the appropriate recharging contact (see below) of a recharging base. For example, a handle could be designed with a raised element (4*k*) that is mated to a slot in a recharging base, so that the handle fits into the recharging base in only one orientation.

Fitted to the handle and extending beyond the handle, is a heating circuit housing (5). The heating circuit housing and the handle may be fitted with one or more of: an interference fit, a catch mechanism, adhesive, or any suitable means, depending on the nature of the connection, to be discussed below.

A Heating Circuit Housing: In its essential features, a heating circuit housing (5) is a hollow, elongated member that is opened near its upper (5*a*) and lower (5*b*) ends, to permit a portion of the electric heating circuit to be reposed through it, with portions of the electric heating circuit emerging from both ends of the housing. The housing does not move substantially in relation to the handle (4) with which it articulates.

Figure 3A:
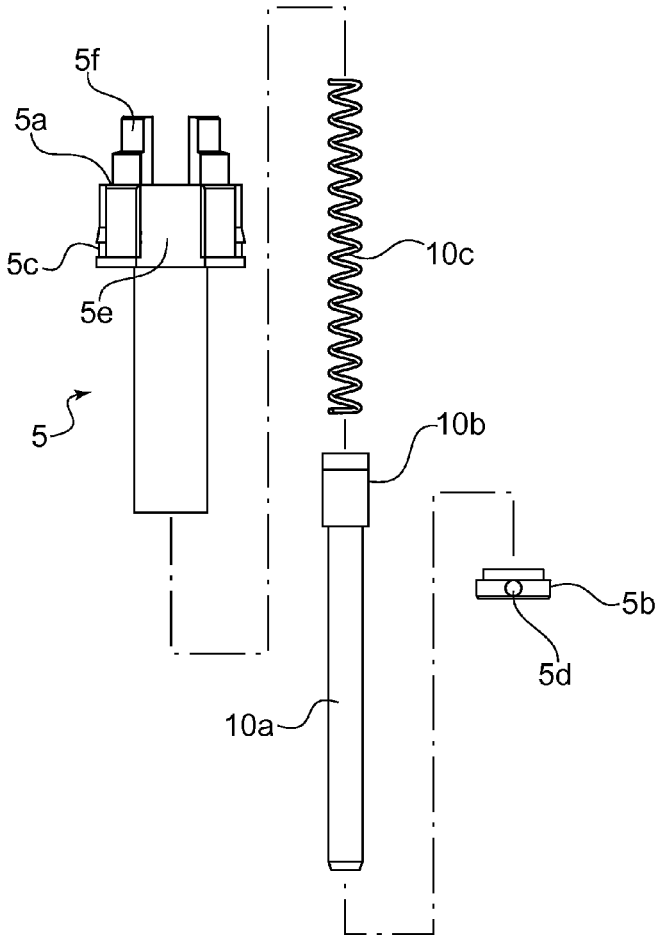
FIGS. 3A and 3B show the assembly of the printed circuit housing and a sliding sleeve mechanism.
Figure 3B:
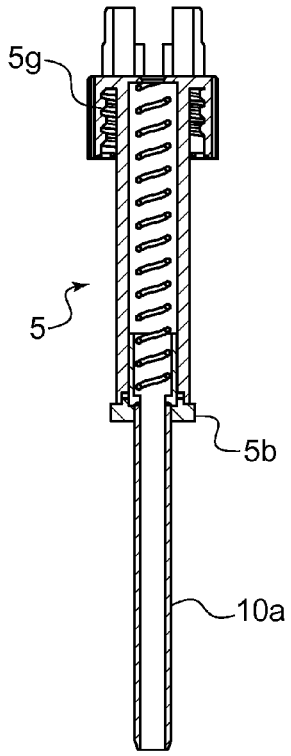

Some embodiments of the present invention have a heating circuit housing (5) as shown in FIGS. 3A and 3B. An upper portion of the heating circuit housing is situated inside the handle (4) such that the housing does not move substantially in relation to the handle. Any suitable means of securing the heating circuit housing against unwanted motion relative to the handle may be used. For example, a portion of the housing may be shaped complimentarily to an interior portion of the handle. For example, in the figures, the upper end (5*a*) of the housing is formed as a roughly cylindrical portion that fits snugly within a cylindrical interior of the handle. To further secure the housing to the handle, detents (5*c*) in the housing for forming a snap fitment to handle, may also be provided.

Referring to FIG. 3A, at least one vertical groove (5*e*) is provided near the upper end (5*a*) of the heating circuit housing (5), while one or more vertical extensions (5*f*) rise above the upper end. The upper end (5*a*) of the housing is formed as a roughly cylindrical portion that is partly hollow and opened near the bottom of the cylindrical portion. In this way, threads (5*g*), disposed on the interior of the cylindrical portion may be engaged. The purpose of these optional features will be explained below.

The lower end (5*b*) of the heating circuit housing (5) is able to form a rigid connection to the neck extension (2), thus joining the first and second subassemblies. In the embodiments covered by FIGS. 3A and 3B, the lower end of the housing is a separate component that snap fits into the main component of the housing, as shown. As discussed above, the connection between subassemblies is detachable so that the second subassembly can be reused with a different first subassembly. Various connection means were discussed above. Once the heating circuit housing and neck extension are connected, the neck extension, applicator head (3), handle (4), and circuit housing (5) are able to behave as one substantially rigid piece. Thus, the applicator head can be raised out of the reservoir (1).

A Switchable Electric Heating Circuit: The system for sampling a heated product further comprises an interruptible or switchable electric heating circuit. In general, when a switch in the circuit is closed, current flows to a heat generating portion, and this defines the heat generating portion as "on". When this switch is opened, current is not flowing to the heat generating portion, and this defines the heat generating portion as "off". When the heating circuit is closed, current flows from the positive terminal of a power source (8), through the heating circuit housing (5), then to a heat generating portion that is capable of being located inside the applicator head (3), back through the heating circuit housing, along one or more leads to a negative terminal of the power source. In general, the electrical path may comprise various electric components that add functionality and/or efficiency to the circuit.

One embodiment of a switchable electric heating circuit comprises a printed circuit board (PCB) (7), a battery (8), a switch which may or may not be mounted on the PCB, and one or more electrical conductors that are not on the PCB. When a PCB is used, then the electric circuit housing (5) is a housing for the printed circuit board, and may be referred to as the PCB housing.

PCB: A printed circuit board (7) is an elongated structure that passes through the PCB housing (5) such that portions of the PCB emerge from either end of the PCB housing. An enlarged portion (7*a*) of the PCB is situated inside the handle (4), near a battery. A lower portion (7*b*) of the printed circuit board supports a heat generating portion (7*c*). The heat generating portion must be able to fit into the hollow stem (3*b*) of the applicator head (3). The bulk of the electronic circuitry is carried on the printed circuit board. The printed circuit board comprises a substrate (7*d*) that is non-conductive to electricity under the conditions of normal or expected use. Suitable substrate materials include, but are not limited to, epoxy resin, glass epoxy, Bakelite (a thermosetting phenol formaldehyde resin), and fiberglass. The substrate may be about 0.25 to 5.0 mm thick, preferably 0.5 to 3 mm, more preferably, 0.75 to 1.5 mm thick. Portions of one or both sides of the substrate may be covered with a layer of copper, for example, about 35 μm thick. The substrate supports one or more heat generating portions, electronic components and conductive elements. Among the conductive elements supported by the PCB, are electrical leads and/or terminals that that are effective to connect the PCB to a battery.

As an example, a printed circuit board (7) will be described that supports various elements in a preferred (but not exclusive) arrangement. The PCB itself may have any shape or dimensions that are convenient to manufacture and assemble into the PCB housing (5), with the requirement that the PCB is able to extend from the electric current source (8), to a distance beyond the distal end of the PCB housing. This distance depends on the overall length and design of the system. In general, the PCB cannot be so long that it would bottom out in the applicator head (3) before the PCB housing and neck extension (2) form a rigid connection.

Figure 4:
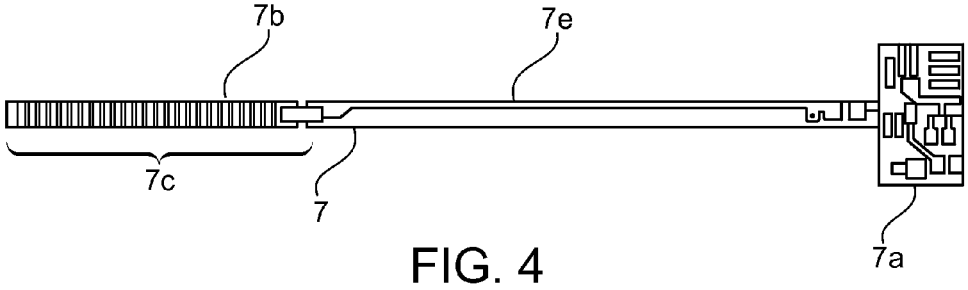
FIG. 4 is a representation of a printed circuit board with heat generating portion.
Figure 8A:
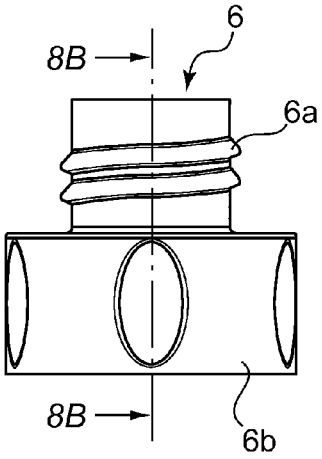
FIGS. 8A and 8B depict a rotating collar, which acts an on-off mechanism.
Figure 8B:
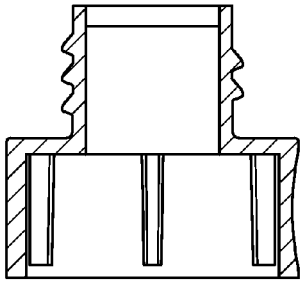
Figure 5:
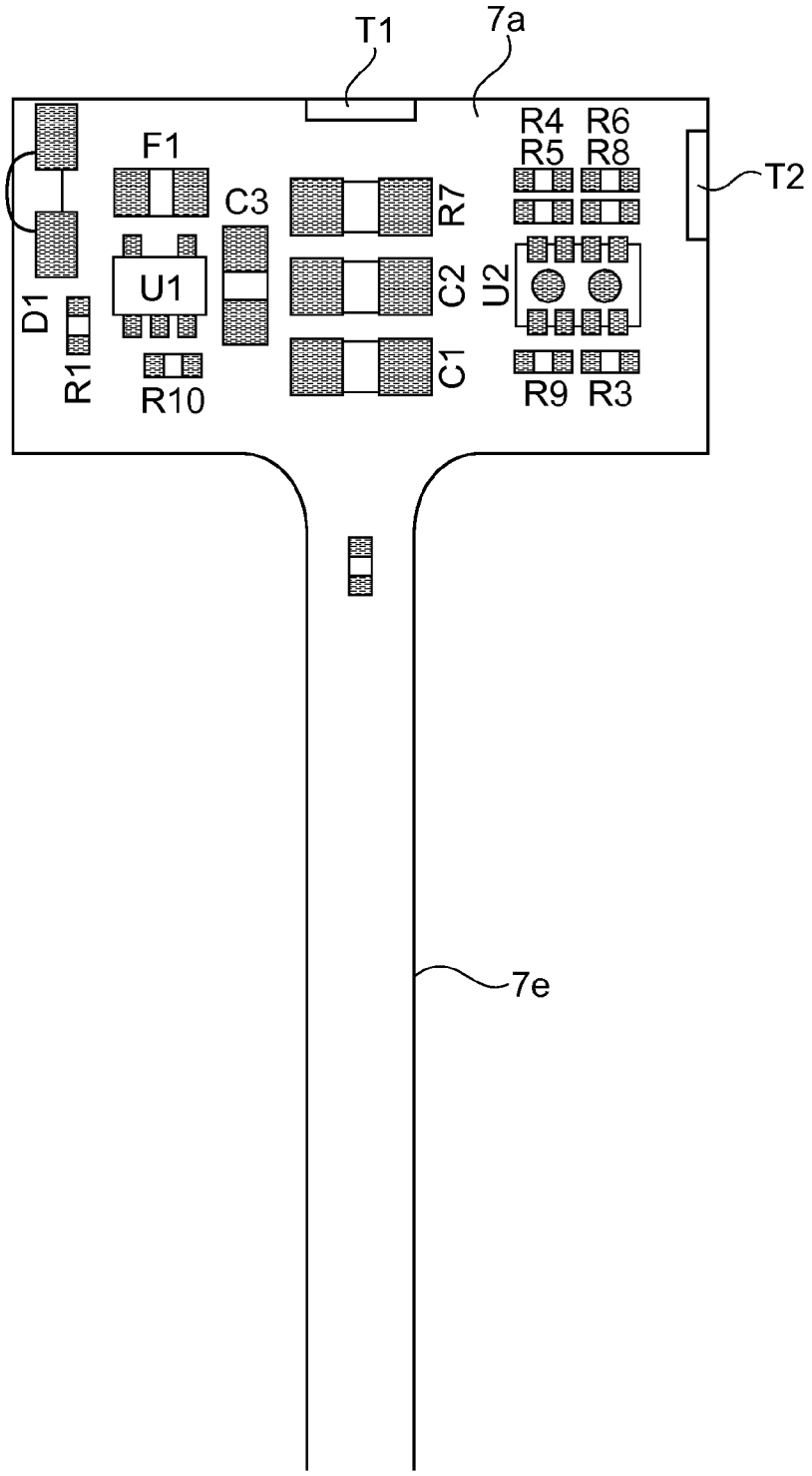
FIG. 5 shows one possible electronic circuit laid out on a printed circuit board.

Referring to FIGS. 4 and 5, all or most of the electronic elements or components except the resistive heating element(s) (7*c*) may be located on the enlarged portion (7*a*) of the printed circuit board, near the upper end of the board. The largest lateral dimension of the enlarged portion of the PCB must be less than an interior dimension of that part of the handle (4) in which it resides. A relatively narrow, elongated section (7*e*) of the PCB extends from the enlarged portion, through the PCB housing (5), and emerges from the lower end of the PCB housing. A portion (7*b*) of the PCB that emerges from the lower end of the PCB housing, holds the heat generating portion (7*c*). Preferably, none of the heat generating portion is inside the PCB housing, as this would tend to reduce the heating efficiency of the system.

Figure 6:
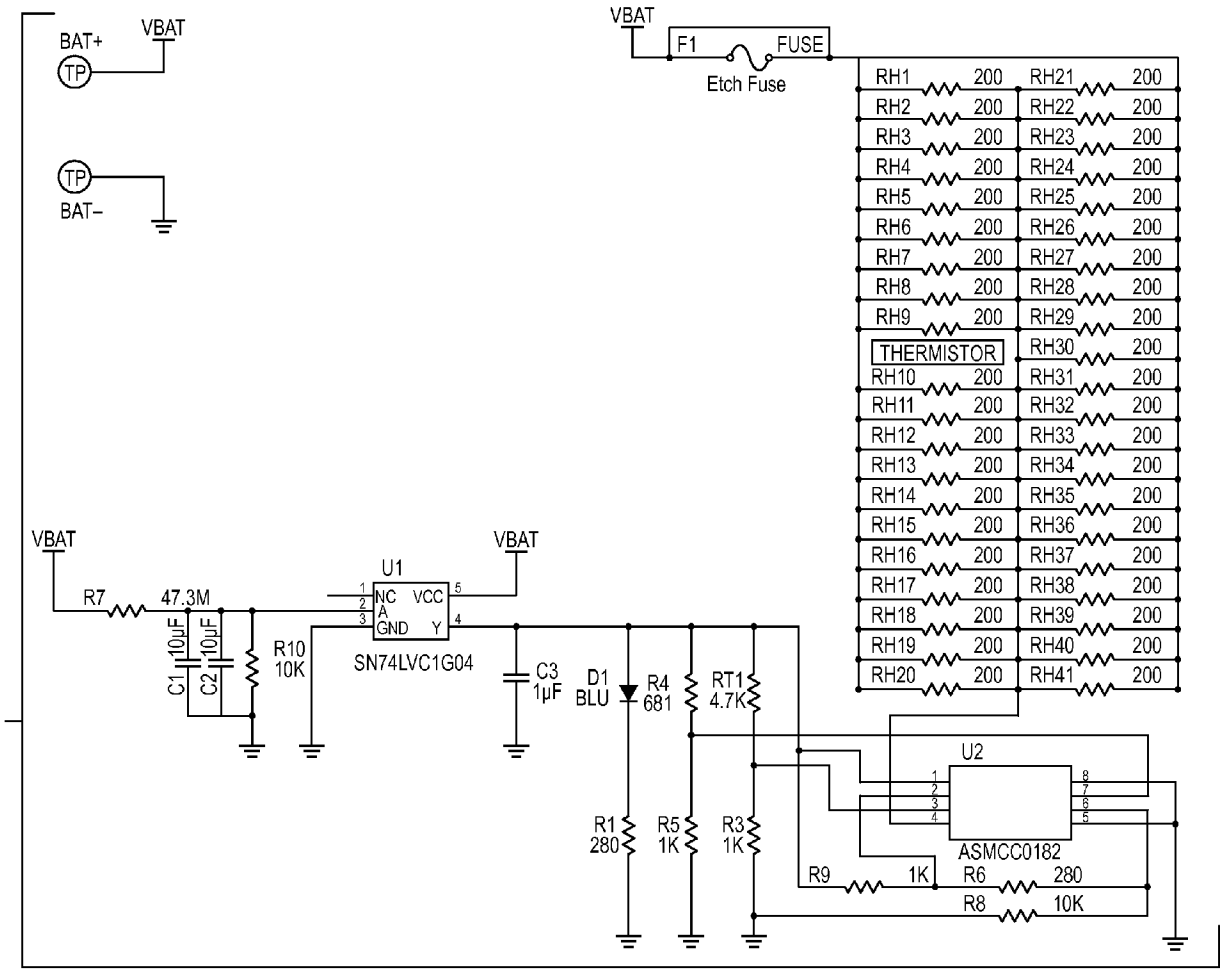
FIG. 6 is a schematic of one possible electronic circuit used in the present invention.

FIG. 6 shows one possible electronic circuit useful in the present invention, which could be laid out on a printed circuit board (7). FIG. 5 shows one possible layout of electronic elements on the PCB. Electric current from a power source (8), (a rechargeable battery, for example) enters the printed circuit board at a PCB terminal (T1). This terminal may occupy an edge of an enlarged portion (7*a*) of the PCB. In a preferred embodiment, the positive terminal of the battery (8) may alternately occupy at least one "on" position and at least one "off" position, according to the positioning of a switch. That is, movement of the switch may physically move the battery. In an "on" position, the positive terminal of the battery physically contacts terminal T1 of the PCB. In the "off" position, the positive terminal of the battery has no physical contact with a terminal of the PCB. This embodiment has the advantage that it does not require additional conductors between the positive terminal of the battery and circuit board. Alternate embodiments for the functioning of switch are possible, according to the well known operation of switches.

Resistor R7 and parallel capacitors C1 and C2, interact with a power inverter U1, to automatically shut off current to the heat generating portion (7*c*) when the capacitors are full. The capacitors may be, for example, ceramic chip capacitors, fastened to or otherwise associated with the PCB. The rated capacitances are chosen to control the length of time from when the switchable circuit is first closed, to when the switchable circuit (and the heat generating portion) will automatically turn off. This overhead timer, automatic shut off feature is optional, and prevents the battery from running down if the user fails to turn off the circuit. Since a user needs time to apply the product after it has been heated, the circuit may be designed to turn off the heat generating portion some amount of time after the heat generating portion has reached a predetermined temperature. This length of time can be chosen according to need, but may typically be from about 2 to 5 minutes. Furthermore, depending on the level of sophistication employed, an overhead timer such as the capacitor-based one shown in FIG. 5, may require a reset period, following an automatic shut off, in which the heating elements cannot be activated (i.e. cannot be "turned on"). The reset time, which may be several seconds, allows the capacitors to discharge.

RT1 is an NTC thermistor. Preferably, the NTC thermistor is physically located in close proximity to the heating elements (7*c*). For example, in the circuit diagram of FIG. 6, a space is shown between heating elements RH9 and RH10. The NTC thermistor may be located in that space, or any space where it could detect slight variations in the ambient temperature of the space surrounding the heating elements. The NTC thermistor and a fixed value resistor R3, are configured as a voltage divider circuit that creates a voltage level that is proportional to and/or varies with the temperature of the heating elements. That voltage level is monitored by an operational amplifier and is passed to the operational amplifier at the inverting input (pin 3 of U2). A threshold reference voltage is produced by another voltage divider circuit at R4 and R5, and this voltage is connected to the non-inverting input (pin 7 of U2) of the operational amplifier. In this way, the operational amplifier is used as a voltage comparator. When the output voltage of the voltage divider circuit that includes the negative temperature thermistor crosses the reference voltage (either rising above or falling below), then the output of the operational amplifier (pin 2 on U2) changes state. The output of the op amp is passed to an N-channel MOSFET switch (at pin 6 of U2), and is used to control the state of MOSFET switch. When the switch is closed, current flows from the switch (at pin 4 of U2) to the resistive heating elements (7*c*). When the switch is opened, current cannot flow to the resistive heating elements. An edge of the enlarged portion (7*a*) of the PCB (7) is provided with a second terminal (T2), which leads to the negative battery terminal through the metal strip (4*d*) and coil/spring (4*e*, see FIG. 2).

The circuit may further include noise reducing components, such as capacitor C3, an on/off indicator, such as LED D1, and multiple fused portions, such as at F1. Also, more than one thermistor can be used to increase the temperature monitoring capabilities.

The circuit, as described, includes a system that actively measures the output temperature and adjusts itself to meet a desired temperature. A system for a heated product that includes this circuit can stay on for an extended period, holding a desired temperature, with no concern for overheating. Also, through the use of an automatic shut off and through the monitoring of the temperature of the heating elements, power utilization is significantly reduced. In this regard, the present invention may provide a commercially feasible, partially disposable, sanitary system for sampling a heated product, with a level of precision and reliability described herein.

The circuit may further include a system for monitoring and maintaining an output voltage of the power source. For example, batteries are rated with a nominal voltage, such 3 volts, but there is some variability from battery to battery, and from use to use of the same battery. An optional system may be included that monitors and adjusts as needed, the battery voltage, to maintain a tighter tolerance of voltage than the battery normally supplies. One benefit of such a system is improved consistency in applicator performance and improved predictability in battery lifetime.

The circuit described above utilizes a printed circuit board (7). The use of a printed circuit board may result in a cost savings, and error reduction in manufacture. Thus, the circuit herein described may provide a truly effective, commercially feasible, aesthetically acceptable, battery powered system for sampling a heated product, with the performance, reliability and convenience herein described, and may well achieve a cost savings and error reduction in manufacturing, compared to devices using more conventional wiring methods. In contrast, without a circuit board as herein described, the creation of a kit for a heated product would be considerably more difficult, more expensive, and less reliable. For the personal care market, creating a system for a heated product without a printed circuit board as herein described, may make the cost of manufacture prohibitive, and the performance of lower quality.

One or more heat generating portions (7*c*) are supported by the lower portion (7*b*) of the printed circuit board. Typically, a heated product according to the present invention may have only one heat generating portion. Preferably, no part of the heat generating portion extends into PCB housing (5), as heating inside the PCB housing wastes energy and decreases efficiency. The heat generating portion (7*c*) may comprise a continuous resistive wire loop or coil. While straightforward, this type of heat generating portion does no offer the performance and energy efficiency of more advanced options, such as an array of discrete heating elements. Therefore, preferably, a heating applicator according to the present invention includes a plurality of individual, discrete resistive heating elements (7*f*), supported on the lower portion (7*b*) of the printed circuit board (7), outside of the PCB housing (5).

A preferred embodiment of the discrete resistive heating elements (7*f*) is a bank of fixed value resistors electronically arranged in series, parallel, or any combination thereof, and physically situated in two rows, one on either side of the PCB (7). The number of resistors and their rated resistance is governed, in part, by the requirements of heat generation of the circuit. In one embodiment, 41 discrete resistors of 5 ohms are uniformly spaced, 20 on one side of the PCB, and 21 on the other side. In another embodiment, 23 6-ohm resistors are used, 11 on one side of the PCB, 12 on the other. In still another embodiment, forty-one 3-ohm resistors are used, 20 on one side, 21 on the other. The side with 1 fewer resistor leaves a space for a thermistor. Typically, an applicator of the present invention might use 10 to 60 individual resistive elements having rated resistances from 1 to 10 ohms. However, these ranges may be exceeded as the situation demands. Typically, the overall resistance of all the heating elements might range from 1 to 10 ohms. However, this range may be exceeded as the situation demands.

One preferred type of resistive heating element is a metal oxide thick film resistor. These are available in more than one form. One preferred form is a chip resistor, which is thick film resistor reposed on a solid ceramic substrate and provided with electrical contacts and protective coatings. Geometrically, each chip may be approximately a solid rectangle. Such heating elements are commercially available, in a range of sizes. For example, KOA Speer Electronics, Inc (Bradford, Pa.) offers general purpose thick film chip resistors, the largest dimension of which is on the order of 0.5 mm or less. By using resistors whose largest dimension is about 2.0 mm or less, better, in one embodiment 1.0 mm or less, even better, in another embodiment 0.5 m or less, the resistors can easily be arranged along the printed circuit board (7), outside of the PCB housing (5).

Typically, chip resistors may be attached to the PCB by known methods. A more preferred form of metal oxide thick film resistor, is available as a silk screened deposit. Without a housing, such as the chip resistor, the metal oxide film is deposited directly onto the printed circuit board, using printing techniques. This is more efficient and flexible from a manufacturing point of view than welding chip resistors. The metal oxide film may be deposited on the PCB as one continuous heating element, or it may be printed as individual dots. Various metal oxides may be used in thick film resistor manufacture. One preferred material is ruthenium oxide ($RuO_2$). The individual dots may be printed as small as about 2.0 mm or less, more preferably 1.0 mm or less, most preferably 0.5 mm or less, and their thickness may vary. In fact, by controlling the size of the dots, one may alter the resistance of each dot. Also, the resistance of the thick film resistor, whether in a chip resistor or silk screened form, may also be controlled by additives in the metal oxide film. Typically, chip resistors and silk screened metal oxide dots of the type described herein, may have a rated resistance of 1 to 10 ohms.

A printed circuit board that carries silk screened thick film resistors or chip resistors, is less bulky than one that carries prior art heating elements such as a wire coil. Less bulky electronics means that the flux of heat into the product is increased, and less heat is wasted.

In general, gaps between the heat generating portion (7*c*) and the applicator head (3) decrease heat transfer efficiency. Therefore, it is preferable if there are as few gaps as possible between the heat generating portion and the inner surface of the applicator head. Therefore, it is preferable if the applicator head fits snugly over the heat generating portion. This will improve the efficiency of heat transfer through the applicator head, from the inside, going out. In one embodiment of the present invention, the inner surface of the hollow stem (3*b*) of the applicator head is in direct contact with a heat generating portion. This arrangement is effective, but still may leave air-filled gaps underneath the applicator head. The transfer of heat through the applicator head and into a product in the reservoir (1) may be diminished by these air-filled gaps. Thus, it is most preferable if there are no such gaps. In another embodiment of the present invention, the heat generating portion is encased in a cylindrical shell of heat transfer material. Making the shell includes embedding the heating elements in a continuous mass of a heat transfer material. The material may be applied by dipping the heat generating portion into heat transfer material that is in a softened state. When the material hardens, there may be substantially no air gaps within the heat generating portion. In at least some embodiments, as long as the heat transfer material improves the rate of heat transfer from the heating elements into the product, then this embodiment is preferred for many applications. The heat transfer material can form a semi-hardened or hardened cylindrical shell over the heat generating portion. The cylindrical shell must fit into the hollow stem (3*b*) of the applicator head (3). Preferably, the cylindrical shell fits snuggly into the hollow stem, to minimize the amount of air in between the cylindrical shell and the hollow stem. Examples of useful materials for the cylindrical shell of heat transfer material include one or more thermally conductive adhesives, one or more thermally conductive encapsulating epoxies or a combination of these. An example of a thermally conductive adhesive is Dow Corning® 1-4173 (treated aluminum oxide and dimethyl, methylhydrogen siloxane; thermal conductivity=1.9 W/m·K; shore hardness 92A). An example of a thermally conductive encapsulating epoxy is 832-TC (a combination of alumina and a reaction product of epichlorohydrin and Biphenyl F; available from MG Chemicals, Burlington, Ontario; thermal conductivity=0.682 W/m·K; Shore hardness 82D). For the heat transfer material, a higher thermal conductivity is preferred over a lower thermal conductivity.

Power Source: Some embodiments of the present invention further comprise a source (8) of electric current, preferably a DC power supply. The current source is housed within the handle (4), which is sufficiently large to accommodate the current source. The current source has at least one positive terminal and at least one negative terminal. One or more of the power source terminals may directly contact a conductive element on the printed circuit board (7), or one or more electrical leads may intervene, like a first metallic lead (4*d*) or spring (4*e*).

In the present invention, each time the heating circuit is activated (or "turned on"), it is preferable if the power source (8) is able to provide, by itself, sufficient energy to raise the temperature of a product, as described herein. In a preferred embodiment, the DC power supply includes one or more batteries, more preferably exactly one battery. Many types of battery may be used, as long as the battery can deliver the requisite power to achieve defined performance levels. Examples of battery types include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries. Common household batteries, such as those used in flashlights and smoke detectors, are frequently found in small handheld devices. These typically include what are known as AA, AAA, C, D and 9 volt batteries. Other batteries that may be appropriate are those commonly found in hearing aides and wrist watches. Furthermore, it is preferable if the battery is disposable in the ordinary household waste stream. Therefore, batteries which, by law, must be separated from the normal household waste stream for disposal (such as batteries containing mercury) are less preferred. Optionally, and preferably, the power source is rechargeable, as discussed above.

A Heating Circuit Switch: An applicator according to the present invention may comprise one or more features that permit a user to engage the heating circuit. Preferably, an applicator according to the present invention comprises at least one mechanism that is capable of alternately interrupting and re-establishing the flow of electricity between the power source (8) and the heating elements (7*c*). In some embodiments, an on-off mechanism has at least two positions. In at least one of the positions the mechanism effects electrical contact between the heat generating portion and the power source, and in at least one of the positions the mechanism interrupts electrical contact between the heat generating portion and the power source.

In one possible embodiment, at least one on/off mechanism is accessible from the outside the system, where it can be engaged, either directly or indirectly, by a user. This type of on-off mechanism is "manual", requiring the user to directly engage the mechanism, which is something that a user does not have to do with a conventional, non-heating dispenser. Some on-off mechanisms must become part of the electric circuit to work. The details of this type of on-off mechanism are well known in the electrical arts. Some non-limiting examples include: toggle switches, rocker switches, sliders, buttons, touch activation surfaces, magnetic switches and light activated switches. Also, multi-position switches or slider switches may be useful, if the heating elements are capable of multiple heating output levels. In general, a manual on-off mechanism may be located anywhere that makes it accessible (directly or indirectly) from the outside the dispenser.

In FIGS. 2, 7, 8 and 9, the on-off mechanism is formed as a rotating collar (6) comprised of a threaded neck (6*a*) sitting on a cylindrical shell (6*b*). The threaded neck is designed to screw into the threaded interior of the cylindrical portion of the heating circuit housing (5). To achieve this, the lower portion of the heating circuit housing must pass through the rotating collar, as shown, so that the rotating collar and heating circuit housing are co-axial. In this arrangement, by rotating the collar (6) with respect to the handle (4), the rotating collar is able to move toward and away from the handle. In conjunction with the rotating collar, one or more tabs (9) are provided, as shown in FIGS. 7A-C. A lower end of each tab is able to contact the rotating collar and an upper end is able to contact the battery (8). Each tab passes from outside the handle to the inside of the handle through a vertical groove (5*e*) in the heating circuit housing (see FIG. 3A). When the rotating collar is screwed toward the handle, the tabs move further into the handle. When this happens, contact between the tabs and the battery forces the battery further up the handle, away from contact with the printed circuit board (7), and compressing the spring (4*e*). Thus, by screwing the rotating collar into the handle, the electric heating circuit is opened, and no current flows to the heat generating portion (7*c*). Simultaneously, recharging lead (4*h*) comes into contact with recharging lead (4*g*), so that recharging of the battery is possible if the device is put into a recharging base. Furthermore, when the rotating collar is screwed away from the handle, the tabs move further out of the handle. When this happens, the spring expands, forcing the battery toward the printed circuit board, until a positive terminal of the battery contacts an electrical lead on the printed circuit board. Thus, by screwing the rotating collar out of the handle, the electric heating circuit is closed, and current flows to the heat generating portion. Simultaneously, recharging lead (4*h*) breaks contact with recharging lead (4*g*), and recharging is not possible, even if the device was put into a recharging base. FIGS. 7A and 7B show the circuit in an off condition, and FIG. 7C shows the circuit in an on condition. For aesthetic reasons, gasket 6*c* is optionally provided in the bottom of the rotating collar, to give a more finished look to the underside of the collar.

In the embodiment just described, the spring (4*e*) serves a dual purpose. A first purpose of the spring, as noted earlier, is to serve as an electrical lead to the negative terminal of the battery (8). A second purpose, is to urge the battery from a first position to a second position. In the first position, when the spring is more compressed against the handle (4), the battery's positive terminal is not making electrical contact with the printed circuit board. In this arrangement, current cannot flow to the heat generating portion (7*c*). In the second position, when the spring is more expanded, the battery's positive terminal is making electrical contact with the printed circuit board, in a way that allows current to flow to the heat generating portion. In a preferred embodiment, the enlarged portion (7*a*) of the printed circuit board comprises an electric lead (T1, in FIG. 5) that is able to contact a positive terminal of the battery, when the battery is in its second position. For example, the electrical lead (T1) is near a proximal edge of the enlarged portion, where a positive terminal of the battery may contact it. Referring to FIG. 3A, one or more vertical extensions (5*f*) rise above the upper end (5*a*) of the electric circuit housing. These extensions may be used to limit the pressure that the spring (4*e*) and the battery (8) exert on the enlarged portion (7*a*) of the printed circuit board (7).

Optional Protection for the Heat Generating Portion: Optionally, when the first and second subassemblies are not attached, a means may be provided for covering the heat generating portion (7*c*) of the printed circuit board (7). One embodiment of this means is a sliding sleeve mechanism. When the subassemblies are not attached, the sleeve covers and protects the heat generating portion from damage, and also protects a user from accidental exposure to a hot heat generating portion. As the heat generating portion is inserted into the applicator head (3), the sleeve is retracted. As the heat generating portion is removed from the applicator head, the sleeve again slides over the heat generating portion.

One embodiment of an optional sleeve mechanism is shown in FIGS. 2A, 2B, 3A and 3B. The sleeve mechanism (10) comprises a sleeve (10*a*), a spring cup (10*b*), and a spring (10*c*). The upper end of the sleeve is attached to the lower end of the spring cup. These pieces may be integrally molded or welded in some suitable fashion. All three pieces are co-axial with the lower portion (7*b*) of the printed circuit board (7), such that the lower portion of the PCB passes through all three pieces. The sleeve is able to move in and out of the heating circuit housing (5), while the spring and spring cup are confined within the heating circuit housing. For example, the size (i.e. diameter) of the spring cup may be large enough to prevent the spring cup from exiting the bottom (5*b*) of the housing. FIG. 3A shows the order of assembly of the spring, spring cup, sleeve and housing bottom into the heating circuit housing. Within the heating circuit housing, the sleeve and spring cup are able to slide up and down when so urged, and the spring is able to expand and contract when so urged. A lower end of the spring sits in the spring cup, and the upper end of the spring pushes against the upper end (5*a*) of the heating circuit housing. As the sleeve and spring cup move toward the handle (4), the heat generating portion (7*c*) of the PCB is exposed, and the spring is compressed. When the spring is allowed to expand, the sleeve and spring cup move away from the handle, and the sleeve covers the heat generating portion. As the heat generating portion is being inserted into the applicator head (3), at some point, the sleeve (10*a*) is prohibited from entering further into the applicator, so that as the printed circuit board continues to be inserted, the heat generating portion emerges from the sleeve. For example, some portion of the sleeve may be designed to interact with some portion of the hollow stem (3*b*) of the applicator head, such that the sleeve is prevented from entering further into the applicator head. That is, the sleeve may bottom out in the hollow stem, while the lower portion (7*b*) of the PCB is able to continue into the applicator head.

Operation of the Applicator

Figure 7C:
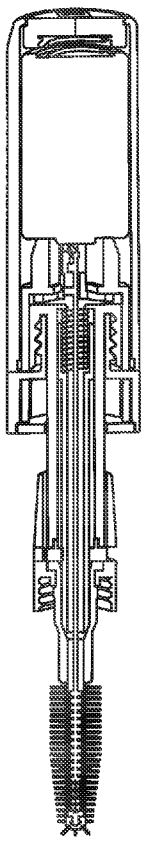
FIGS. 7A-C and 9A-C demonstrate the use of an applicator according to one embodiment of the present invention.
Figure 7B:
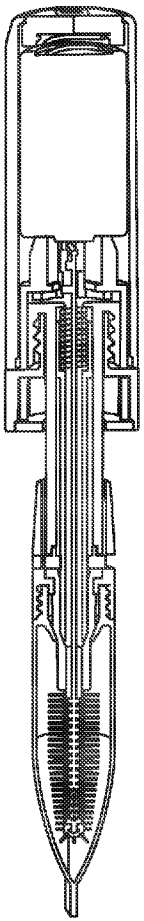
Figure 7A:
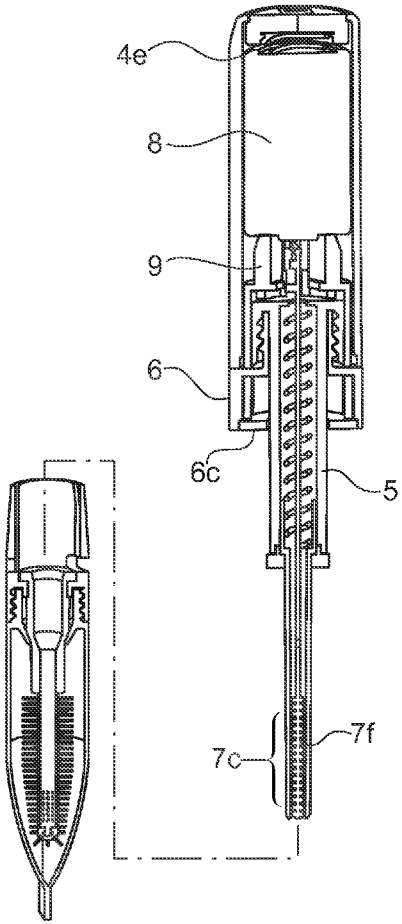
Figure 9C:
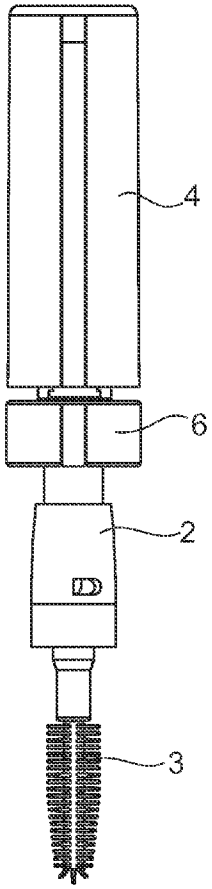
Figure 9B:
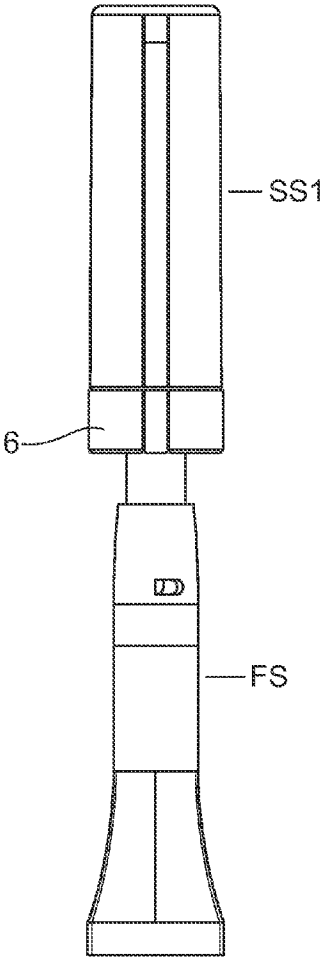
Figure 9A:
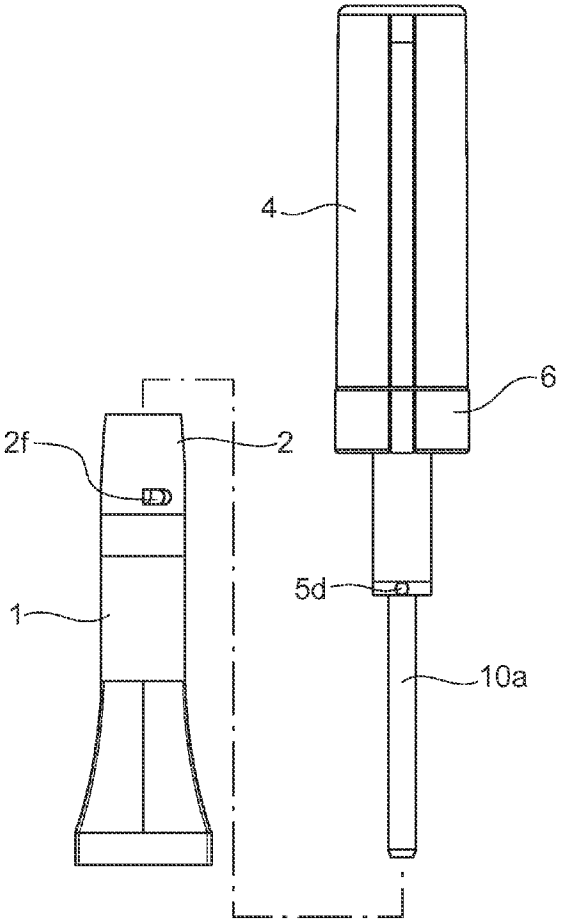

FIGS. 9A-C demonstrate the use of the applicator as so far described. FIGS. 7A-C demonstrate the same use, only in cross section. FIGS. 7A and 9A depict a first subassembly and a second subassembly prior to joining. The rotating collar (6) is in the off position, and the sleeve (10*a*) is covering the heat generating portion. Optionally, if the rotating collar is put into the on position, then an advantage of the sliding sleeve mechanism may be realized. If the heating circuit is turned on while the sleeve (10*a*) is covering the heat generating portion, then heat generating portion will heat up faster because the heat is trapped within the sleeve, very close to the heat generating portion.

FIGS. 7B and 9 B show the second subassembly inserted into the first subassembly. Although the rotating collar is still shown in the off position, in intended use a user will usually want to turn the rotating collar to the on position while the heat generating portion is disposed in the product reservoir (1), if she has not already done so. When the lugs (5*d*) are engaged in their respective locking grooves (2*f*), the first and second subassemblies are fixedly joined. At this point, neck extension (2) and applicator head (3) can be removed from the reservoir (1) by an unscrewing motion applied to the handle (4).

FIGS. 7C and 9C shows the applicator head out of the reservoir, and the rotating collar (6) is shown in the on position. The heat generating portion inside the applicator head is heating up and heating the product on the working surface (3*a*) of the applicator head.

When a user is done applying the product, she may turn off the heating circuit, return the applicator head (3) to the reservoir (1), and tightly seal the reservoir to preserve the contents of the reservoir between uses. Eventually, when the contents of the reservoir are exhausted, the user can disengage the lug(s) (5*d*) from the locking groove(s) (2*f*), and the second subassembly is recovered. The first subassembly, which preferably does not comprise any electrical components, may be discarded, and the second subassembly may be reused with a new first subassembly.

Some alternative designs for the second subassembly will now be described. In the drawings of the alternative embodiments that follow, features that are substantially the same as described above are numbered the same, while substantially modified features and new features have new numbering.

The Reusable Second Subassembly—A Second Set of Embodiments (SS2)

Figure 10A:
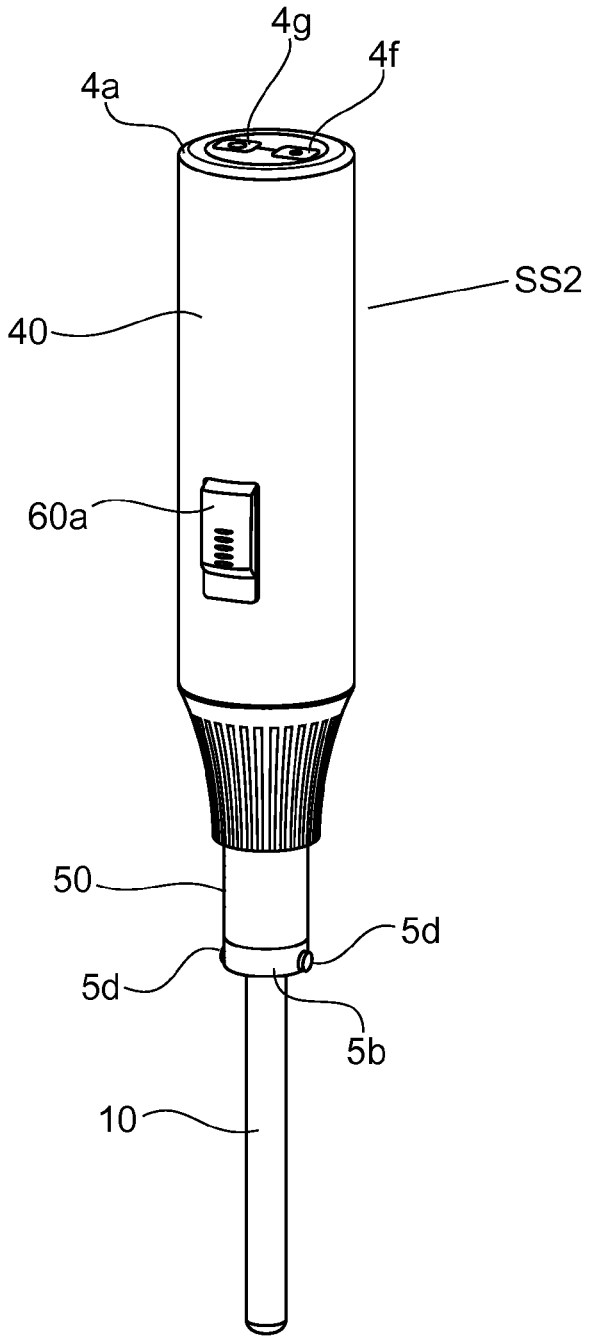
FIG. 10A is a perspective view of a second embodiment of a reusable second subassembly of the present invention.
Figure 10B:
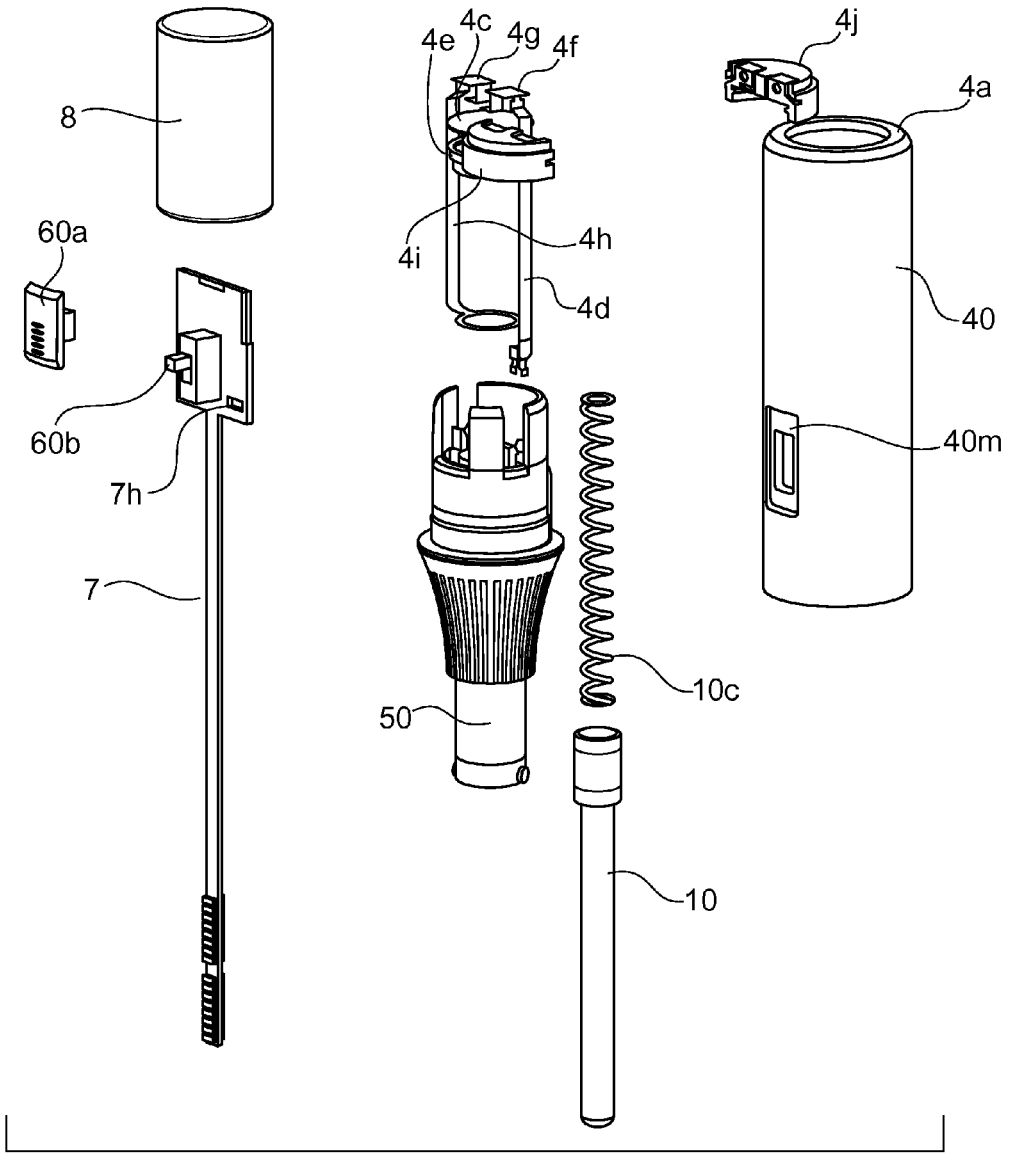
FIG. 10B is an exploded view of the subassembly of FIG. 10A
Figure 11:
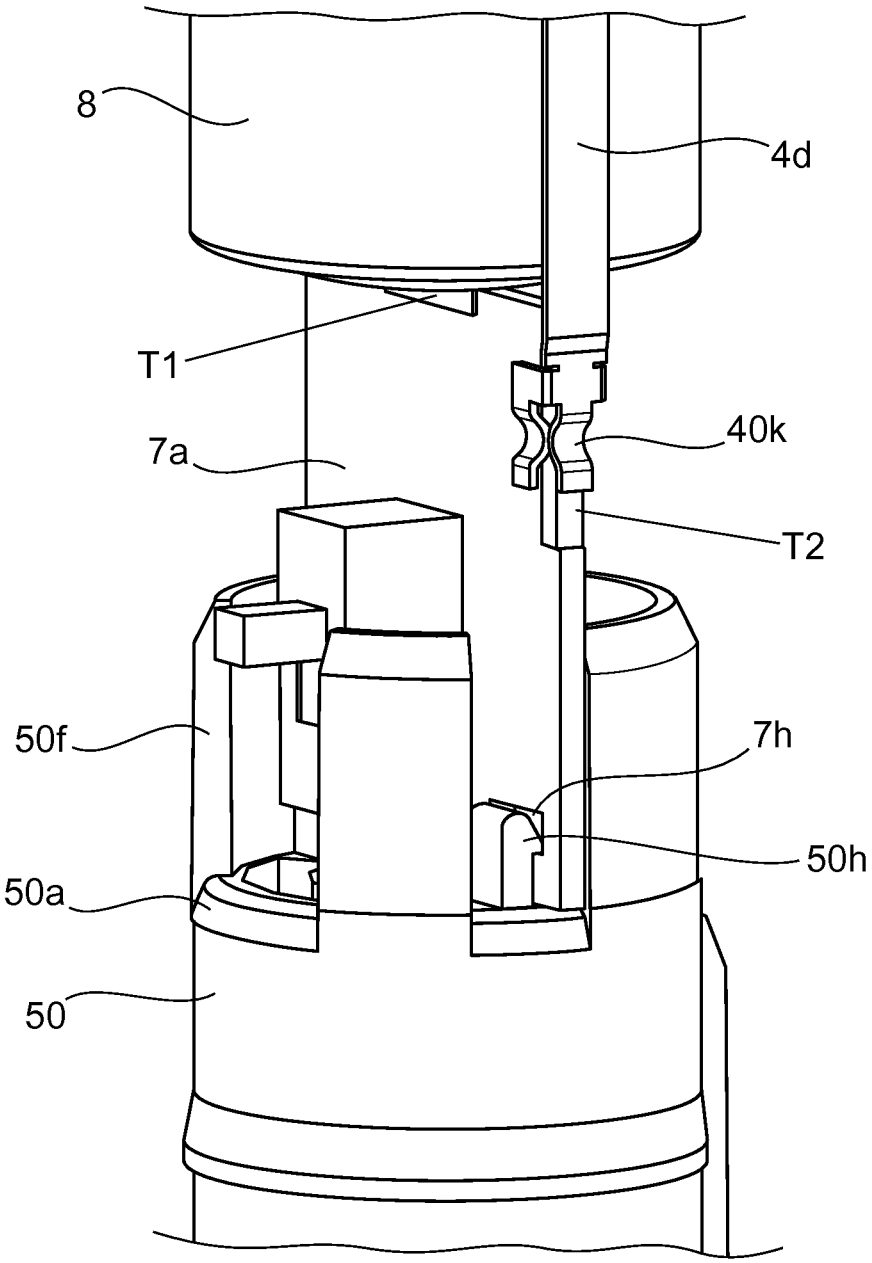
FIG. 11 shows one embodiment of a contact between the first metallic lead (4*d*) and second terminal (T2) of the printed circuit board.

FIGS. 10-13 shows a second embodiment of the second subassembly (SS2). One obvious difference from the second subassembly described above is that the on-off switch of the heating circuit is a sliding switch (60*b*) having a switch cover (60*a*). The sliding switch is mounted directly into the printed circuit board (7), such that the sliding switch is able to open and close the heating circuit. With this type of switch, the positive terminal of the battery maintains physical contact with the printed circuit board at PCB terminal (T1). Thus, the rotating collar (6), and tabs (9) are no longer needed. The switch cover (60*a*) slides in switch slot (40*m*) and a portion of the switch cover passes through handle (40) to connect to switch (60*b*). The recharging leads (4*f*, 4*g*) are accessible near the top (4*a*) of the handle. FIG. 11 shows one embodiment of a contact between the first metallic lead (4*d*) and second terminal (T2) of the printed circuit board. In this case, the end of the first metallic lead is formed as three prongs (40*k*) that sandwich the second terminal on three sides.

The heating circuit housing (50) is similar to, but differs somewhat from that described above. For example, in this embodiment, the housing still has an upper end (50*a*) situated inside the handle (40) such that the housing does not move substantially in relation to the handle. Also, the housing still has one or more vertical extensions (50*f*) rise above the upper end. Three such extensions are shown in FIGS. 10*b* and 11, which are designed to help secure the enlarged portion (7*a*) of the printed circuit board (7). However, the upper end of the housing may not require a vertical groove to accommodate tabs (9), since the tabs have been eliminated. Also the upper end of the heating circuit housing does not have threads on an interior surface, since the rotating collar has been eliminated. The absence of the rotating collar allows a tapered transition (or any other shape or aesthetic feature) to be implemented between the upper and lower ends of the circuit housing. Another feature of some embodiments of the heated circuit housing (50) is the presence of one or more locking tabs (50*h*) arising from the top (50*a*) of the housing. These tabs are designed to catch in mated slots (7*h*) on the enlarged portion of the printed circuit board, to help securely hold the printed circuit board in relation to the heating circuit housing.

Figure 12C:
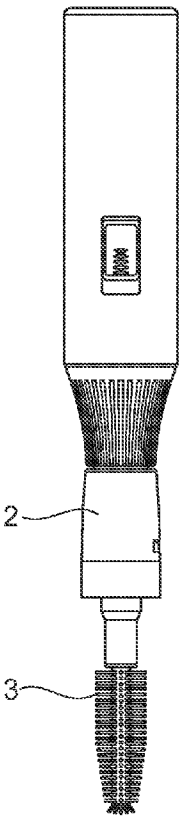
FIGS. 12A-C demonstrate the use of an applicator having the second subassembly of FIG. 10A.
Figure 12B:
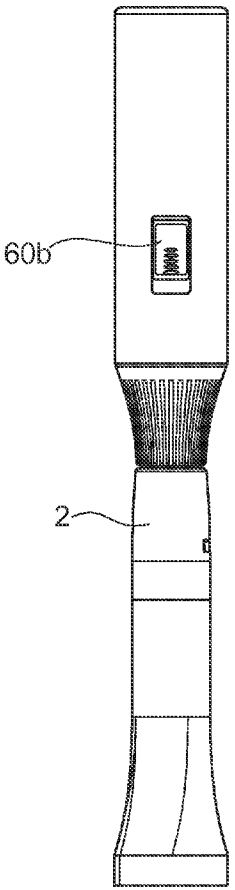
Figure 12A:
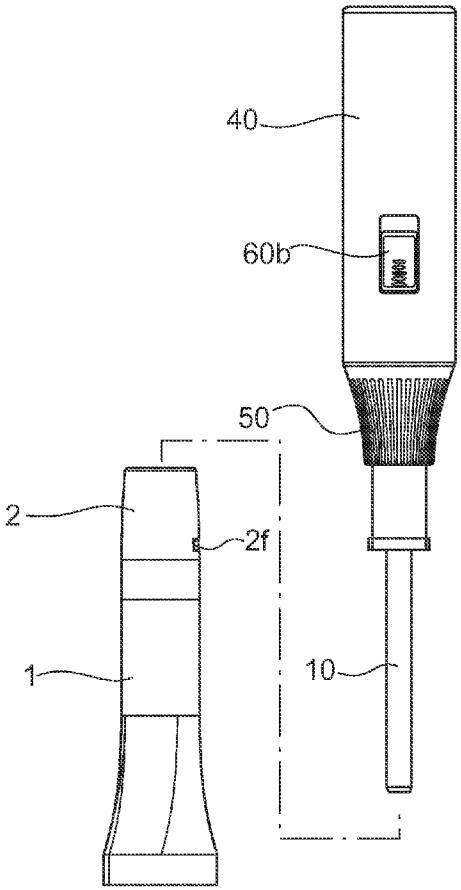
Figure 13:
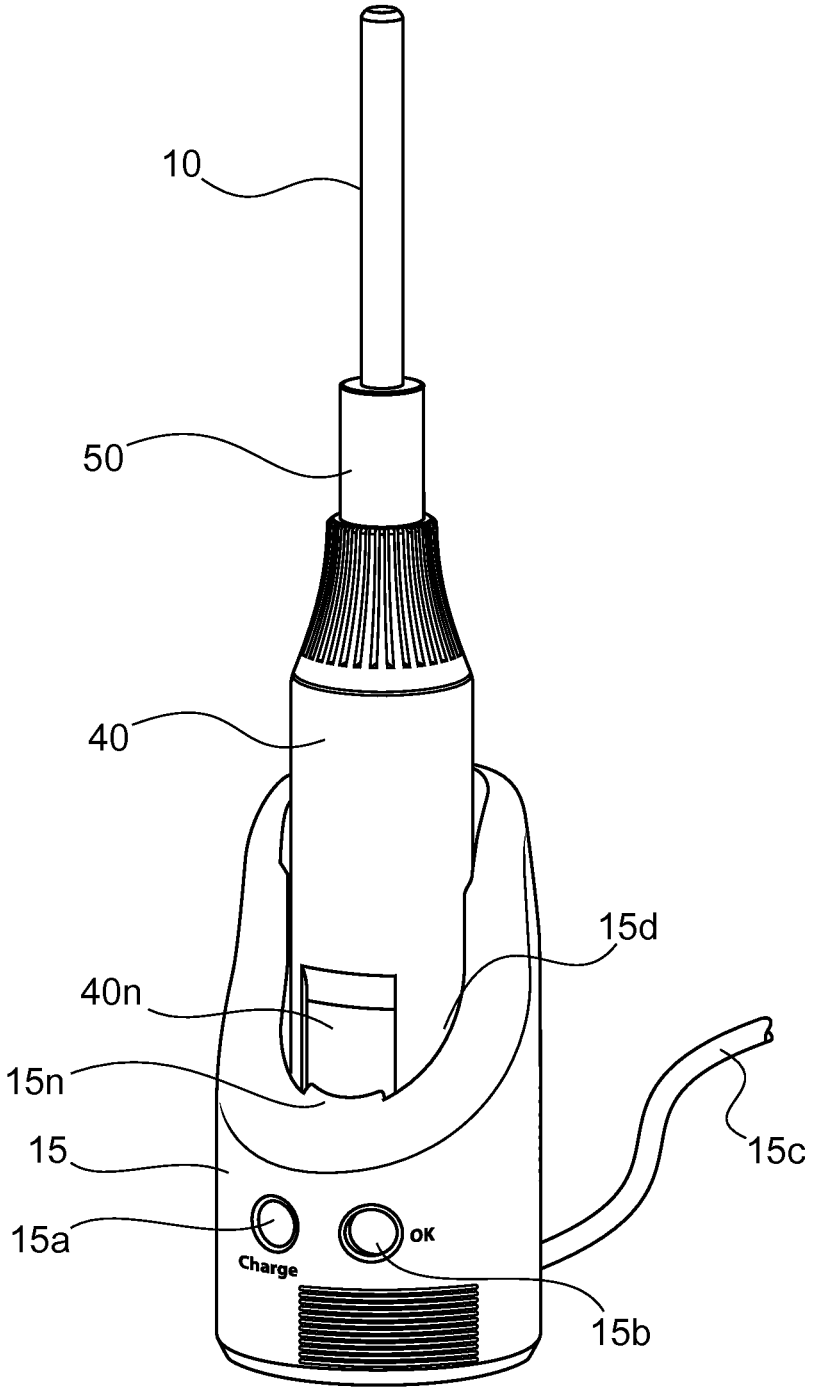
FIG. 13 shows one embodiment of a recharging base that is suitable for those embodiments where the recharging leads are accessible near the top of the handle.

As above, the lower end (50*b*) of the heating circuit housing is able to form a rigid connection to the neck extension (2), thus joining the first and second subassemblies. As discussed above, the connection between subassemblies is detachable so that the second subassembly can be reused with a different first subassembly. Various connection means were discussed above, such as a lug-style fitment. In FIGS. 10A, 12A and 13, two lugs (5*d*) are provided, each of which is accommodated in its own transit groove (2*e*) and locking groove (2*f*) in the neck extension (2). Once the heating circuit housing and neck extension (2) are connected, the neck extension, applicator head (3), handle (40), and heating circuit housing (50) are able to behave as one substantially rigid piece. Thus, the applicator head can be raised out of the reservoir (1).

The Reusable Second Subassembly—A Third Set of Embodiments (SS3)

Figure 14A:
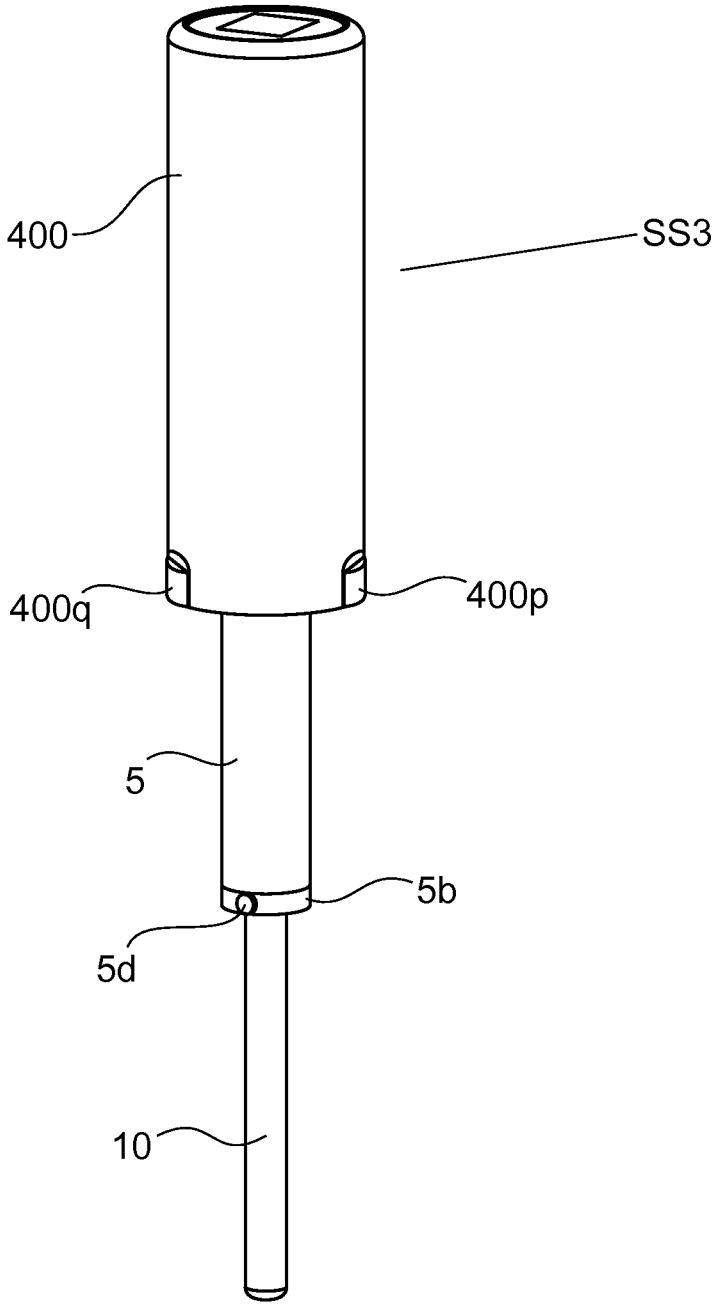
FIG. 14A is a perspective view of a third embodiment of a reusable second subassembly of the present invention.
Figure 14B:
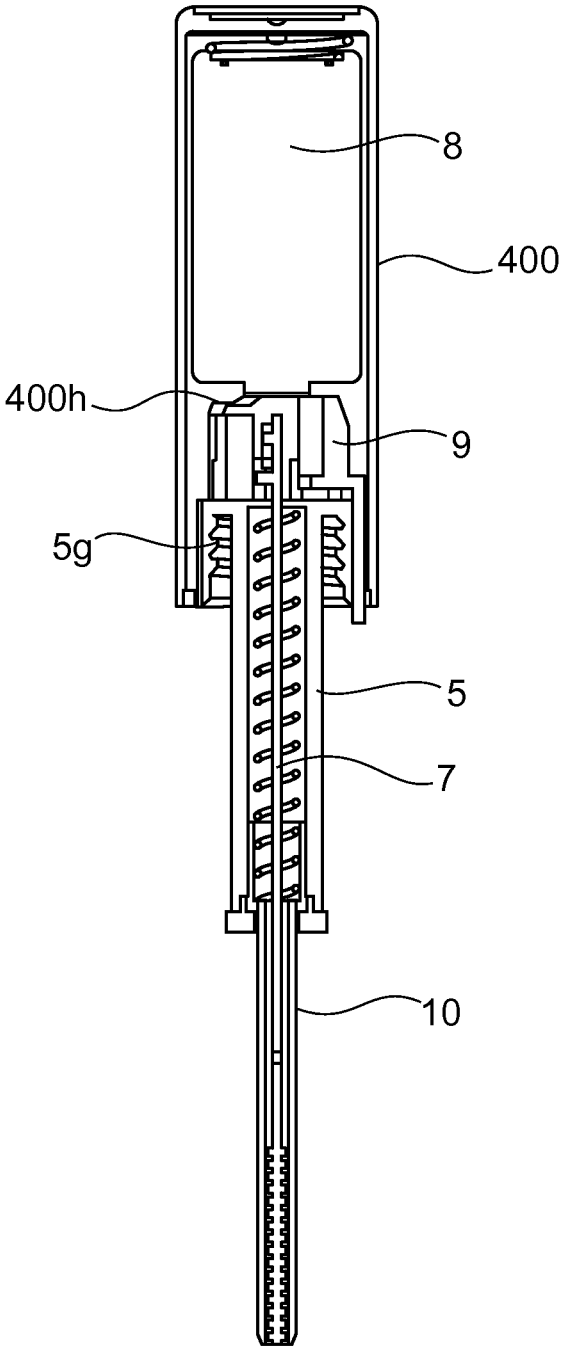
FIG. 14B is a cross sectional view of the subassembly of FIG. 14A.
Figure 14C:
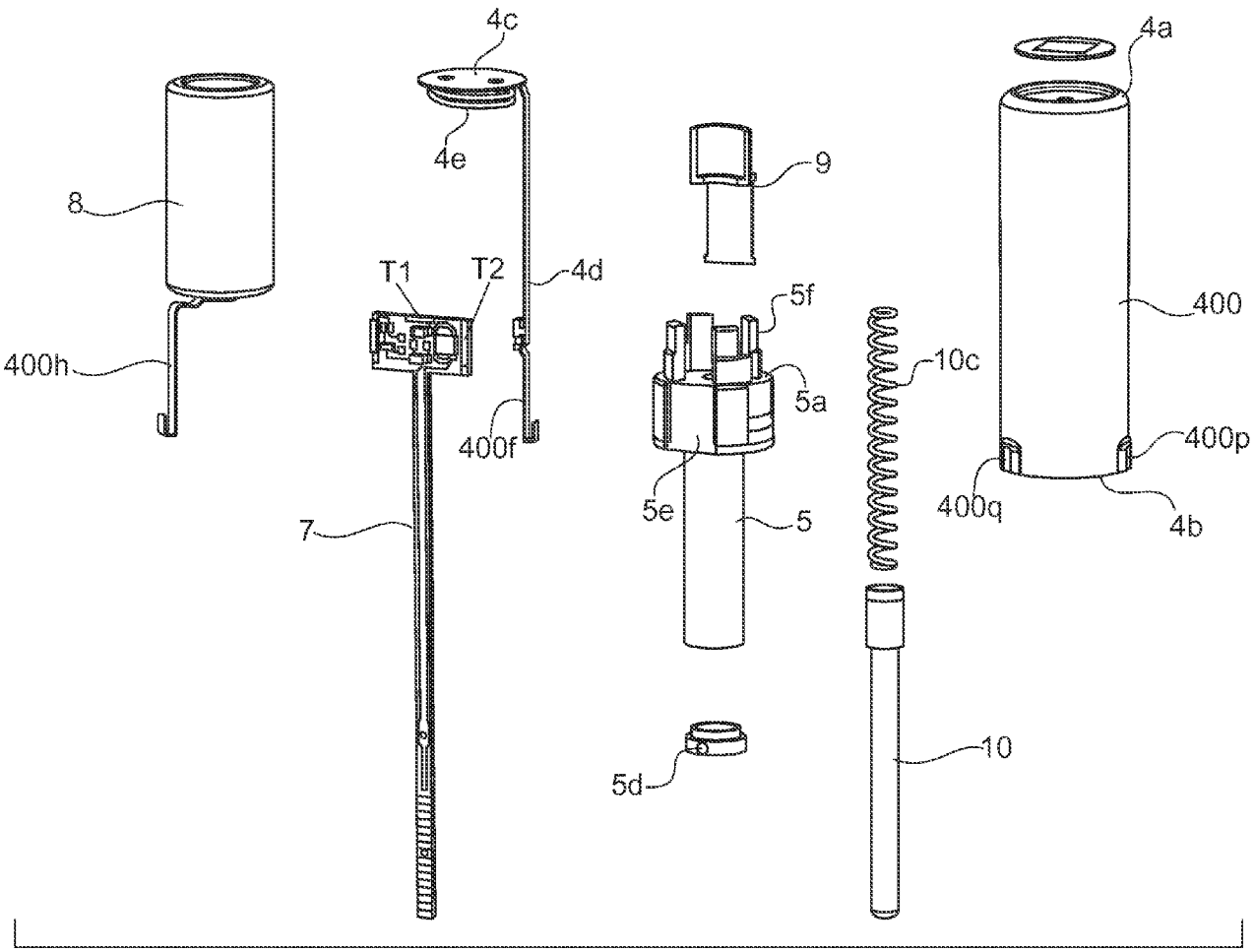
FIG. 14C is an exploded view of the subassembly of FIG. 14A.

FIGS. 14A-C show a third embodiment of the second subassembly (SS3). As in the first embodiment of the reusable second subassembly, a spring (4*e*) serves a dual purpose. A first purpose of the spring, as noted earlier, is to serve as an electrical lead to the negative terminal of the battery (8). A second purpose, is to urge the battery from a first position to a second position. In the first position, when the spring is more compressed against the handle (400), the battery's positive terminal is not making electrical contact with the printed circuit board. In this arrangement, current cannot flow to the heat generating portion (7*c*). In the second position, when the spring is more expanded, the battery's positive terminal is making electrical contact with the printed circuit board, in a way that allows current to flow to the heat generating portion. In a preferred embodiment, the enlarged portion (7*a*) of the printed circuit board comprises an electric lead (T1) that is able to contact a positive terminal of the battery, when the battery is in its second position. Also, the heating circuit comprises battery (8), electric lead T1, the circuitry of the printed circuit board (7), electric leads (T2), (4*d*), (4*c*) and spring (4*e*). The recharging circuit differs from the first and second embodiments in the position of recharging leads. In this case, the recharging circuit is accessible near the bottom (4*b*) of the handle (400). For example, negative recharging lead (400*f*) depends downwardly from lead (4*d*), which leads back to the negative terminal of the battery (8). Positive recharging lead (400*h*) is welded to and depends downwardly from the positive terminal of the battery. Both recharging leads wrap around the bottom edge of the handle, and may continue up the outside of the handle for a short distance. To secure the recharging leads and to register the leads in a recharging base, slots (400*p*, 400*q*) may be provided in the outside of the handle. Because one end of the positive recharging lead is welded to the battery, this lead is sufficiently flexible to accommodate the movement o the battery. The purpose of this will be seen below.

The heating circuit housing (5) is like that of the first embodiment of the second subassembly. The housing still has an upper end (5*a*) situated inside the handle (400) such that the housing does not move substantially in relation to the handle. The housing has one or more vertical extensions (5*f*) that rise above the upper end (5*a*) of the housing, which has at least one vertical groove (5*e*) to accommodate a tab (9). Also, like the first embodiment, the upper end of the heating circuit housing has threads (5*g*) on an interior surface, but these are not for attaching to a rotating collar switch, which is not present in this embodiment. In this case, the on-off switch of the heating circuit is engaged when the second subassembly is mounted and demounted from a base, as described below. As above, the lower end (5*b*) of the heating circuit housing is able to form a rigid connection to a neck extension (2), thus joining the first and second subassemblies. A detachable lug-style fitment may be preferred. Once the heating circuit housing and neck extension (2) are connected, the neck extension, applicator head (3), handle (40), and heating circuit housing (5) are able to behave as one substantially rigid piece. Thus, the applicator head can be raised out of the reservoir (1).

The on-off mechanism now described is one example of an automatic switching mechanism. "Automatic switching" means that the heating circuit and/or recharging circuit are turned on or off as a result of normal use of the applicator. In this case, the applicator is used in conjunction with a base, which may be a recharging base or simply a convenience stand for storing the applicator when not in use. As noted above, one or more tabs (9) are provided, as shown in FIG. 14B. A lower end of the tab is able to extend below the bottom (4*b*) of the handle (400) and an upper end is able to contact the battery (8). The tab passes from outside the handle to the inside of the handle through a vertical groove (5*e*) in the heating circuit housing. As the threads (5*g*) of the heating circuit housing (5) are screwed down onto a base, the tab contacts a surface of the base. As a result the tab moves further into the handle. When this happens, contact between the tab and the battery forces the battery further up the handle, away from contact with the printed circuit board (7), and compressing the spring (4*e*). Thus, the electric heating circuit is opened, and no current flows to the heat generating portion (7*c*). However, the flexible positive recharging lead (400*h*) maintains contact with the positive terminal of the battery, so that a recharging circuit may be completed. When the threads (5*g*) are not engaged, then the tabs are free to move further out of the handle. When this happens, the spring expands, forcing the battery toward the printed circuit board, until a positive terminal of the battery contacts electrical lead (T1) of the printed circuit board. Thus, by disengaging threads (5*g*), the electric heating circuit is closed, and current flows to the heat generating portion. With an automatic switching mechanism, the heating circuit is turned on and off by virtue of removing the applicator from or returning the applicator to a base.

Performance Factors

Various parameters of the heated applicators described herein will affect the amount of heat required to raise the temperature of a product in the reservoir (1) and/or the amount of time required to do it. For example, in general the more product in the reservoir, the more heat will be needed to raise the temperature of the product to a product application temperature, in a given amount of time. Also, for example, given a specific rate of heat generation, a thicker applicator head (3) means more time will be needed to raise the temperature of the product in the reservoir. To increase the rate of heat transfer through the applicator head, and to reduce the amount of heat lost, it may be preferable to make the hollow stem (3*b*) of applicator head as thin as possible, considering the limitations of manufacture in the specific material used. Preferably, the thickness of the wall of the applicator head is less than 1.0 mm, more preferably less than 0.8 mm, even more preferably less than 0.6 mm and most preferably less than 0.4 mm. Of course, since heat passes through the applicator head, the amount of heat and/or the length of time needed to raise the temperature of a product disposed in the reservoir also depends on the thermal conductivity of the material(s). So, in general, to decrease the amount of time required to raise the temperature of the product, one might increase the rate of heat generation, decrease the mass being in heated (thinner applicator head), and/or increase the thermal conductivity of the applicator head.

Heated applicators according to the present invention are configured to raise the temperature of a dose of product from an ambient temperature to a product application temperature. That temperature may be adjusted to market demands. For example, the product application temperature may be 30° C. or greater, or 40° C. or greater, or 50° C. or greater, or 60° C. or greater, and so on, as the situation dictates. Immediately prior to application, an applicator herein described is able to heat an amount of product from an ambient temperature to a product application temperature, in 60 seconds or less, preferably 30 seconds or less, more preferably 15 seconds or less, and most preferably 5 seconds or less. As a result of heating, some characteristic of the dispensed product is enhanced or improved. The enhanced or improved characteristic may be for example a reduction in viscosity, activation of an active ingredient, a threading effect in a mascara product, a longer shelf life, a feeling of warmth experienced by the consumer, enhanced penetration of the product into the skin of a user, release of an encapsulated ingredient, or any other change that benefits the user.

Some Optional Features

Recharging Base

As described above, the second subassembly (SS) may comprise a rechargeable power source. In some embodiments described herein, the exterior of the handle (4) is provided with recharging leads that allow the rechargeable power source in the handle to be connected to an external power reservoir. Some embodiments of the present invention comprise a recharging means. A recharging means is able to effect electrical contact between the recharging leads of the second subassembly and the external power reservoir. Once the electrical contact is made, electrical power is able to be transmitted from the external power source, to the rechargeable power source for storage. One embodiment of a recharging means is a current/voltage regulating cord. One end of the cord is mated to the recharging leads of the handle (4) and the other end is provided with a plug suitable for home electrical outlets. In another embodiment, the recharging means takes the form of a docking station or recharging base. A recharging base will have one or more ports for receiving a second subassembly. The port is such that when a second subassembly is disposed therein, electrical contact is established between the recharging leads of the second subassembly and the external power reservoir. The external power reservoir may reside in the recharging base, or the recharging base itself has to be plugged into an external power source. Above, we have described different embodiments of the recharging leads of the second subassembly. The configuration of the port(s) of the recharging base will depend on the location of the recharging leads (i.e. at the top or bottom of the handle). A recharging base may have exactly one port, since the present invention requires only one second subassembly. However, more ports may be provided to accommodate any number of second subassemblies. In some embodiments of a recharging base, the battery (8) may be recharged while the neck extension (2) and applicator head (3) are attached to the second subassembly. However, due to the short operational lifetime of the neck extension and applicator head, these components may be disposed before recharging.

FIG. 13 shows one embodiment of a recharging base (15) that is suitable for those embodiments where the recharging leads (4*f*, 4*g*) are accessible near the top (4*a*) of the handle (40). The embodiments covered by FIGS. 2A and 10A are examples of this type. In some embodiments the recharging base may have various indicator lights. For example, indicator light (15*a*) is able to signify that power source (8) is being charged, and indicator light (15*b*) is able to signify that the power source is fully charged or sufficiently charged for intended use. A power cord (15*c*) enables the recharging base to be plugged into a household-type current source. The recharging base comprises any electrical componentry needed to regulate and/or modulate the source current coming from through the power cord. In FIG. 13, the second subassembly is shown in a port (15*d*) of the recharging base without a first subassembly attached. However, there is nothing that prevents recharging of the power source when a first subassembly is attached to the second subassembly. Also, the handle (40) and recharging base (15) may optionally be provided with a means of registering the recharging leads (4*f*, 4*g*) of the handle with the appropriate leads of the recharging base. For example, in FIG. 13 the recharging base is provided with a detent (15*n*) that cooperates with a groove (40*n*) of the handle, so that the handle can only be inserted in the recharging port (15*d*) in a configuration that is effective to recharge the power source (8).

Figure 15:
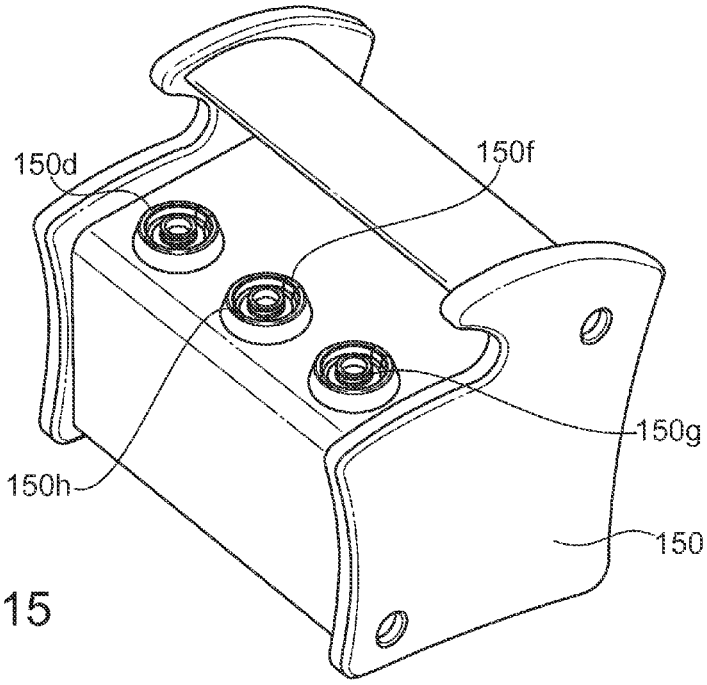
FIG. 15 shows one embodiment of a recharging base that is suitable for those embodiments where the recharging leads are accessible near the bottom of the handle.
Figure 16:
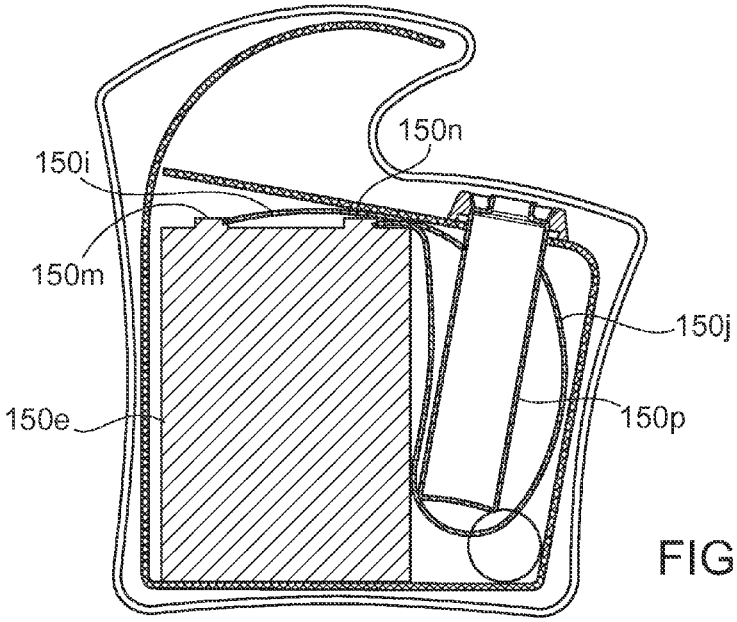
FIG. 16 is a cross section view of the recharging base of FIG. 15.

FIGS. 15 and 16 show one embodiment of a recharging base (150) that is suitable for those embodiments where the recharging leads (4*f*, 4*h*) are accessible near the bottom (4*b*) of the handle (400). The embodiments covered by FIG. 14A are examples of this type. The base comprises a power reservoir or a means to connect to a power reservoir. The power reservoir may be municipal source that can be accessed via an electrical outlet and power cord. In this case, the recharging base comprises any electrical componentry needed to regulate and/or modulate the source current coming through the power cord. Alternatively, the recharging base may be provided with self contained power reservoir (150*e*), which may itself be rechargeable. In this case, the recharging base would be more fully portable than if it always had to be connected to an external power reservoir.

The base has at least one recharging port (150*d*). Preferably, the base has more than one port, so that more than one second subassembly can be recharged simultaneously. Preferably, the base has at least three recharging ports. Thus, the recharging base (150) may be more suitable for in-store counter use, where several second subassembly may be needed at one time, as opposed to home use. Each port is comprised of a threaded collar (150*g*) into which the printed circuit board (7) is disposed. The threaded collar is mated to engage the threads (5*g*) of the heated circuit housing. When the housing is screwed down onto the threaded collar, the recharging leads (400*f*, 400*h*) of the handle (400) register with negative (150*f*) and positive (150*h*) electrical contacts of the collar. These electrical contacts are electrically connected to the power reservoir (150*e*) by any suitable circuitry, such as conductors (150*i*, 150*j*) that conduct electricity to and from negative (150*m*) and positive (150*n*) terminals of the power reservoir. Thus, by engaging threads (5*g*), the electric heating circuit is opened so that no current flows to the heat generating portion, but at the same time, the recharging circuit is closed and battery (8) is recharged. Likewise, by disengaging threads (5*g*), the recharging circuit is opened, but at the same time the electric heating circuit is closed, and current flows to the heat generating portion. With this type of automatic switching mechanism, the heating and recharging circuits are in opposite states (on or off). For example, when in the base, the recharging circuit is necessarily closed and the heating circuit is necessarily opened. When out of the base, the recharging circuit is necessarily opened and the heating circuit is necessarily closed.

Optionally, a container (150*p*) depends from each port (150*d*), down into the base. The container provides a secure and sanitary location for the printed circuit board while the second subassembly is in the recharging base. In some embodiments the recharging base may have various indicator lights as mentioned above. Preferably, the power reservoir is able to simultaneously recharge as many second subassemblies as there are ports (150*d*). Preferably, the power reservoir is able to recharge at least three second subassemblies before itself needing to be recharged; more preferably at least 5 second subassemblies; even more preferably at least 10 second subassemblies before needing to be recharged.

Automatic Switch

In some embodiments, the heating elements may be automatically switched on and off (i.e. activated and deactivated). "Automatically switched" means that the heating elements are turned on or off as a result of normal use of the applicator. For example, when the PCB housing (5 or 50) is being attached to the neck extension (2), the heating generating portion (7*c*) may be activated, and then deactivated as the PCB housing is being detached from the neck extension. The advantage here is that the there is no chance that the heating generating portion will be left on when it is not inserted in an applicator head.

Multiple Switches

In another embodiment, there may be more than one on-off mechanism in a single heating dispenser. A first on-off mechanism could be a manual on-off mechanism, such as described above, and a second on-off mechanism could be an automatic switch. These could be wired to operate as a so-called "three-way" switch, giving a user the option of overriding the automatic switch.

Temperature Indicator

The present invention is configured to raise the temperature of a dose of product from an ambient temperature to a product application temperature in a defined amount of time. Since the consumer may have to wait for heating to occur, the dispenser may be provided with an indication that the product has reached application temperature, and application can begin. For example, a portion of the exterior surface of the reservoir (1) may be fashioned from a material that reacts to changes in temperature, i.e. by changing color. In this case, the "thermochromic" surface should be sufficiently close to the heat generating portion so that a visible color change occurs within a several seconds of the product in the chamber reaching application temperature; i.e. no more than 10 seconds, preferably, no more than 5 seconds, more preferably no more than 3 seconds. Alternatively, the electric circuit may include an LED that lights up when the product in the reservoir has reached an application temperature. The system may also have an LED that lights up as soon as the heating circuit is closed, to tell a user that the heating circuit is on.

Other Circuits

The second subassembly may comprise electric circuits other than the heating circuit. These may offer a user other functionality or convenience. For example, electric circuits may be provided for a vibration system, a lighting system, a sound system, one or more logic circuits, one or more memory circuits, one or more communications circuits, one or more signal transmission systems, one or more signal processing systems, etc.

Products for Use in a Heated Applicator System According to the Present Invention A non-exhaustive list of product types that may benefit from being supplied in an applicator system according to the present invention includes: products heated for aesthetic reasons (i.e. shave cream); those heated to activate an ingredient; those heated to alter the rheology of the product; those heated to sterilize the product; those heated to release an encapsulated ingredient, as by melting a gelatin capsule, for example. Particularly preferred products are eyelash products, such as mascara. Forms of product include creams, lotions, serums, gels, liquids, pastes, powders or any product that may be applied with a handheld applicator of the types known to be used in the cosmetic and personal care fields.

As described herein, the reservoir (1) of the system is designed to hold a finished product. A "finished product" is one that could be used even without heating, or one that requires only heating prior to use. Therefore, products that require additional preparation beyond heating, may not be suitable or may be less suitable for the present invention. For example, a pre-shave foam mixture that must be combined with a liquid propellant outside of the reservoir (1), would not be suitable for use in the present invention. An exception to this includes products that can be constituted by shaking the reservoir prior to use. In general, the products may be mixtures, suspensions, emulsions, dispersions or colloids. Particularly preferred products are those that could be exploited by having some structural or dynamic property temporarily altered by heating. For example, heating may temporarily reduce the viscosity of a mascara product to improve application and make application easier, whereas, after cooling, the viscosity of the mascara may return to near pre-heating levels.

In general, as a material is heated, the change in temperature varies inversely with the heat capacity of the material. Therefore, considering the time and energy required to heat product contained in the reservoir (1), products having a smaller heat capacity may be thought of as more efficient than products having a larger heat capacity. Among cosmetic liquids, water has one of the higher heat capacities. Therefore, in general a personal care composition with less water may heat more efficiently than one with more water, all else being the same. For some applications then, it may be preferable to use a product that has less than 50% water, more preferably less than 25% water, and more preferably still less than 10% water and most preferably, an anhydrous product. Of course, not every type of product can be implemented as an anhydrous or low water product, and personal care compositions having 50% or more of water may still be suitable for use in a kit according to the present invention.

Methods of Use

A first subassembly, as described herein, whose reservoir (1) contains enough product for 1 to 14 applications, including product that cannot be evacuated, is provided. A second subassembly, as described herein, for example the second subassembly of FIG. 10A, is also provided. Prior to any use, the first and second subassemblies are physically separated, as shown in FIG. 12A. At this point, there are several steps whose order may vary. These include, inserting the heat generating portion (7*c*) into the hollow interior of the applicator head (3), turning on the heating circuit, separating the neck extension (2) from the reservoir (1), and raising the applicator head out of the reservoir. For example, the steps of inserting the heat generating portion and turning on the heating circuit may be performed in either order. Also, the steps of separating the neck extension from the reservoir and turning on the heating circuit may be performed in either order. Also, the steps of raising the applicator head out of the reservoir and turning on the heating circuit may be performed in either order.

Once the neck extension and reservoir are separated, the applicator head is rigidly associated with the second subassembly. Once raised out of the reservoir (1), the applicator head (3) can be used to transfer heated product to an intended surface, such as hair or skin. Thereafter, the applicator head may be returned to the reservoir to retrieve more product or to store the applicator head for a later use. After the applicator has been used, the heating circuit can be turned off.

Additional method steps may include reconnecting the neck extension and reservoir and/or reinserting the applicator head (3) into the reservoir (1). Also, at whatever point the heating circuit is turned on, the user may wait a recommended amount of time for the product on the applicator head to heat up, and for some characteristic of the product to be improved or enhanced. In general, the actual amount of time for the product to heat will depend on the method used. For example, a longer amount of time may be required when the heating circuit is engaged after the applicator head is out of the reservoir. A shorter amount of time may be required when the heat generating portion is heating as it sits in the reservoir. The tight confines of the reservoir should improve heating efficiency compared to heating the applicator head outside of the reservoir.

Once the contents of the reservoir are exhausted, the heating circuit housing (50) may be separated from the neck extension (2) (for example, by disengaging the lug-style fitment), and the heat generating portion (7*c*) can be removed from the interior of the applicator head (3). At this point, the second subassembly has been recovered, and may be reused with another first subassembly. For hygienic reasons, the exhausted reservoir (1), neck extension (2) and used applicator head (3) are disposed.

The step of waiting a period of time may include the user waiting at least as long as directed by someone or something other than the user. In general, the waiting period may be less than 60 seconds, preferably 30 seconds or less, more preferably 15 seconds or less, even more preferably 10 seconds or less. Alternatively, the user may wait until a thermochromic material has visibly changed color. Some or all of the above steps may be performed at least once per week; for example, at least five times per week; for example, at least once per day; for example, at least twice per day; for example, at least three times per day.

Conclusion

We have described a heating applicator system for products that tend to dry out when heated. However, the system is also suitable to alleviate problems other than dry-out that may arise due to over-exposure to heat from a heating applicator. With our new system, the most expensive components are reused, while the tainted, but relatively inexpensive components are disposed. The present invention eliminates or substantially reduces the occurrence of product degradation, such as dry out of mascara, in the reservoir and on the applicator head. The present invention is not limited to the embodiments described herein.

We claim:

1. A heating applicator system comprising:

a disposable first subassembly that comprises:

a reservoir that has a top end in the form of a hollow neck, the neck having an upper orifice that provides access to the interior of the reservoir;

a hollow neck extension that is connected to the neck of reservoir in a detachable and reattachable manner, such that the upper orifice of the reservoir is surrounded by the neck extension; and an applicator head that depends from the neck extension and passes through the upper orifice and into the reservoir, the applicator head comprising:

a hollow stem that has an opened proximal portion and a closed distal portion, wherein the closed distal portion supports a working surface;

such that, when the reservoir, neck extension and applicator head are assembled, the interior of the reservoir is sealed off from the ambient environment, and the working surface of the applicator head is immersed in the reservoir; and a passage exists through the neck extension, and into the closed distal portion of the applicator head; and a reusable second subassembly that comprises:

a hollow handle having a proximal end and an opened distal end;

a power source located in the handle;

a hollow, electric heating circuit housing that has an upper end and a lower end, wherein the upper end of the housing is secured to the handle, and the lower end of the housing is able to form a rigid, detachable connection to the neck extension; and an electric heating circuit that passes through the electric circuit housing, such that a heat generating portion of the heating circuit emerges from the lower end of the housing;

wherein when the electric circuit housing is made to form a rigid connection to the neck extension, then the heat generating portion is disposed inside the applicator head.

2. The system of claim 1 further comprising a wiper element that is formed as a conically shaped down-turned portion that depends from the lower end of the neck.

3. The system of claim 1 wherein the neck extension is connected to the neck of reservoir through cooperating threads.

4. The system of claim 1 wherein the electric heating circuit comprises a printed circuit board, and the heat generating portion comprises a plurality of individual, discrete resistive heating elements supported on a lower portion of the printed circuit board, outside of the electric circuit housing.

5. The system of claim 4 wherein the printed circuit board comprises a substrate that is non-conductive to electricity, and that supports electronic components and electrical leads that are effective to connect the heat generating portion to the power source.

6. The system of claim 5 that automatically turns off the heat generating portion about 2 to 5 minutes after the heat generating portion has reached a predetermined temperature.

7. The system of claim 6 which includes a voltage divider circuit and a thermistor.

8. The system of claim 7 which further comprises an operational amplifier and an N-channel MOSFET switch.

9. The system of claim 4 wherein the heating elements are a bank of fixed value resistors electronically arranged in series, parallel, or any combination thereof, and physically situated in two rows, one on both sides of the printed circuit board.

10. The system of claim 9 wherein the fixed value resistors have rated resistances from 1 to 10 ohms.

11. The system of claim 10 wherein the overall resistance of all the heating elements ranges from 1 to 10 ohms.

12. The system of claim 11 wherein the resistive heating elements are metal oxide thick film, chip resistors, the largest dimension of which is 2.0 mm or less.

13. The system of claim 11 wherein the resistive heating elements are discrete dots of a metal oxide thick film, provided as a silk screen deposit on the printed circuit board.

14. The system of claim 13 wherein the metal oxide thick film is comprised of ruthenium oxide (RuO2), and each dot is 2.0 mm or less.

15. The system of claim 4 wherein the resistive heating elements are embedded in a continuous, solid mass of a heat transfer material.

16. The system of claim 15 wherein the heat transfer material is one or more thermally conductive adhesives, one or more thermally conductive encapsulating epoxies or a combination of these.

17. The system of claim 1 wherein the rigid, detachable connection of the heating circuit housing to the neck extension is implemented as a lug style locking mechanism, wherein:

the neck extension comprises at least one transit groove and at least one locking groove that extends at an approximately right angle to the transit groove; and the circuit housing comprises at least one cooperating lug that is able to travel down the transit groove, and enter into the locking groove.

18. The system of claim 1 wherein the power source can be accessed through a removable cap in the proximal end of the handle.

19. The system of claim 1 further comprising positive and negative recharging leads on the exterior of the handle, which are able to be electrically connected to an external power reservoir, such that when the external power reservoir is connected, a recharging circuit is completed that is effective to transmit power from the external power reservoir to the power source for storage.

20. The system of claim 19 wherein the recharging leads wrap around the bottom edge of the handle.

21. The system of claim 19 further comprising a recharging base that has one or more ports that are capable of receiving the second subassembly, such that when the second subassembly is disposed therein, electrical contact is established between the recharging leads of the second subassembly and the external power reservoir.

22. The system of claim 19 wherein the external power reservoir resides in the recharging base, and the recharging base has at least three ports, wherein each port is comprised of:

a threaded collar into which the printed circuit board is disposed; and a container that depends from each port, down into the recharging base.

23. The system of claim 1 further comprising an on-off mechanism that has at least two positions, in at least one of the positions the mechanism effects electrical contact between the heat generating portion and the power source, and in at least one of the positions the mechanism interrupts electrical contact between the heat generating portion and the power source, wherein the mechanism is accessible from the outside of the dispenser, and can be engaged, either directly or indirectly, by a user.

24. The system of claim 1 further comprising a sliding sleeve that covers the heat generating portion when the first and second subassemblies are not attached, and that is retracted into the heating circuit housing as the heat generating portion is inserted into the applicator head.

25. A method of using a heating applicator system comprising the steps of:

providing a heating applicator system according to claim 1, wherein the first and second subassemblies are initially physically separated, and wherein the reservoir contains enough product for 1 to 14 applications;

inserting the heat generating portion into the hollow interior of the applicator head;

connecting the heating circuit housing to the neck extension;

turning on the electric heating circuit;

separating the neck extension from the reservoir;

raising the applicator head out of the reservoir.

26. The method of claim 25 further comprising one or more of:

transferring heated product to the hair or skin;

reinserting the applicator head into the reservoir;

turning off the heating circuit;

separating the heated circuit housing from the neck extension;

removing the heat generating portion from the interior of the applicator head;

reconnecting the neck extension and reservoir;

disposing of the reservoir, applicator head, and neck extension; and/or reusing the second subassembly with another first subassembly.

* * * * *